US012543824B2

(12) United States Patent
Berrian et al.

(10) Patent No.: US 12,543,824 B2
(45) Date of Patent: Feb. 10, 2026

(54) LIGHTWEIGHT KNITTED UPPER AND METHODS OF MANUFACTURE

(71) Applicant: NIKE, Inc., Beaverton, OR (US)

(72) Inventors: Travis J. Berrian, Beaverton, OR (US); Mark S. Bruce, Beaverton, OR (US); Ajay Chadha, Beaverton, OR (US); Stephen J. Hipp, Beaverton, OR (US); Timothy K. Liles, Beaverton, OR (US); John S. MacGilbert, Beaverton, OR (US); William C. McFarland, II, Beaverton, OR (US); Colin M. Runkle, Beaverton, OR (US); Peter R. Savage, Beaverton, OR (US); Hirotaka Usui, Beaverton, OR (US); Yang Zhao, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 220 days.

(21) Appl. No.: 18/306,020

(22) Filed: Apr. 24, 2023

(65) Prior Publication Data

US 2023/0255316 A1 Aug. 17, 2023

Related U.S. Application Data

(62) Division of application No. 16/535,415, filed on Aug. 8, 2019, now Pat. No. 11,659,892.

(60) Provisional application No. 62/767,818, filed on Nov. 15, 2018, provisional application No. 62/716,128, filed on Aug. 8, 2018.

(51) Int. Cl.

| | |
|---|---|
| ***A43B 23/02*** | (2006.01) |
| ***A43B 1/04*** | (2022.01) |
| ***D04B 1/10*** | (2006.01) |
| ***D04B 1/26*** | (2006.01) |

(52) U.S. Cl.

CPC ..... *A43B 23/0205* (2013.01); *A43B 1/04* (2013.01); *D04B 1/26* (2013.01); *D04B 1/10* (2013.01); *D10B 2501/043* (2013.01)

(58) Field of Classification Search

CPC ..... A43B 23/0205; A43B 1/04; A43B 1/02; A43B 1/01; A43B 1/028; A43B 1/023; D04B 1/26; D04B 1/10; D10B 2501/043; D10B 2401/061

See application file for complete search history.

(56) References Cited

U.S. PATENT DOCUMENTS

| | | | |
|---|---|---|---|
| 3,287,938 | A | 11/1966 | Knohl |
| 4,255,877 | A | 3/1981 | Bowerman |

(Continued)

FOREIGN PATENT DOCUMENTS

| | | | |
|---|---|---|---|
| CN | 104334043 | A | 2/2015 |
| CN | 106174877 | A | 12/2016 |

(Continued)

OTHER PUBLICATIONS

Partial European Search Report received for Patent Application No. 24222209.9, mailed on May 8, 2025, 18 pages.

*Primary Examiner* — Nahida Sultana

(74) *Attorney, Agent, or Firm* — Shook, Hardy & Bacon L.L.P.

(57) ABSTRACT

Methods of manufacture, including exposing the upper to steam while in a tensioned state to at least partially melt the fusible yarn to adjacent yarns is described. Subsequent cooling of the fusible yarn retains the upper in a stretched condition.

16 Claims, 11 Drawing Sheets

(56) References Cited

U.S. PATENT DOCUMENTS 5,083,361 A * 1/1992 Rudy ..... B32B 7/02 29/454
5,385,036 A * 1/1995 Spillane ..... A43B 1/04 66/196
5,896,758 A 4/1999 Rock et al.
6,116,059 A 9/2000 Rock et al.
7,168,188 B2 1/2007 Auger et al.
7,748,240 B1 7/2010 Cherneski
8,484,940 B2 * 7/2013 Bruner ..... D04B 1/04 139/393
8,595,878 B2 12/2013 Huffa et al.
8,839,532 B2 9/2014 Huffa et al.
9,333,066 B2 * 5/2016 Martin ..... A61F 2/0063
9,861,160 B2 1/2018 Podhajny et al.
11,659,892 B2 * 5/2023 Berrian ..... D04B 1/26 36/45
12,091,786 B2 * 9/2024 Dombrow ..... A43B 23/0235
2002/0056502 A1 * 5/2002 Bordes ..... A41D 27/245 156/289
2005/0081402 A1 4/2005 Orei et al.
2005/0115284 A1 6/2005 Dua
2005/0193592 A1 9/2005 Dua et al.
2008/0110048 A1 5/2008 Dua et al.
2009/0182070 A1 * 7/2009 Miyazono ..... D01F 8/14 523/523
2010/0154256 A1 6/2010 Dua
2010/0186255 A1 7/2010 Avar et al.
2013/0263629 A1 10/2013 Gaither
2014/0227474 A1 * 8/2014 Cramer ..... D06C 7/00 28/165
2014/0245633 A1 9/2014 Podhajny
2015/0047225 A1 2/2015 Zavala et al.
2015/0086965 A1 * 3/2015 Zamir ..... G09B 1/325 434/379
2015/0250256 A1 9/2015 Podhajny
2015/0272274 A1 10/2015 Berns et al.
2016/0058098 A1 3/2016 Cross et al.
2016/0295971 A1 * 10/2016 Arnese ..... A43B 13/223
2016/0302527 A1 10/2016 Meir
2017/0202295 A1 7/2017 Macgilbert et al.
2017/0258169 A1 9/2017 Zavala
2018/0002839 A1 * 1/2018 Liao ..... D03D 1/00
2018/0008006 A1 1/2018 Boys et al.
2018/0042333 A1 2/2018 Manos et al.
2018/0116339 A1 5/2018 Luh
2018/0125158 A1 5/2018 Adami et al.
2018/0305848 A1 * 10/2018 Motoya ..... D04B 21/12
2018/0317593 A1 11/2018 Dealey
2018/0317594 A1 11/2018 Brinkman et al.
2019/0037959 A1 2/2019 Berrian et al.
2019/0037968 A1 2/2019 Dewillie et al.
2019/0223540 A1 7/2019 Cox et al.
2019/0365049 A1 12/2019 Verfl
2020/0029647 A1 * 1/2020 Unnewehr ..... D04B 1/24
2020/0046074 A1 2/2020 Berrian et al.
2022/0151341 A1 * 5/2022 Filipescu ..... D04B 1/10
2023/0083354 A1 * 3/2023 Byun ..... B33Y 80/00 28/101

FOREIGN PATENT DOCUMENTS

CN 108056532 A 5/2018
CN 207341288 U 5/2018
CN 108294407 A 7/2018
EP 3011854 A1 4/2016
KR 20150086965 A * 1/2014 ..... D06P 7/00
WO 2017/123752 A1 7/2017

* cited by examiner

LIGHTWEIGHT KNITTED UPPER AND METHODS OF MANUFACTURE

RELATED APPLICATIONS

This application is a divisional of co-pending U.S. application Ser. No. 16/535,415, filed Aug. 8, 2019, and entitled "Lightweight Knitted Upper and Methods of Manufacture," which claims priority benefit of U.S. Provisional Application No. 62/716,128, filed Aug. 8, 2018, and entitled "Lightweight Knitted Upper and Methods of Manufacture," and U.S. Provisional Application No. 62/767,818, filed Nov. 15, 2018, and entitled "Lightweight Knitted Upper and Methods of Manufacture," all of which are hereby incorporated by reference in their entireties.

BACKGROUND

A variety of articles are formed from textiles. As examples, articles of apparel (e.g., shirts, pants, socks, footwear, jackets and other outerwear, briefs and other undergarments, hats and other headwear), containers (e.g., backpacks, bags), and upholstery for furniture (e.g., chairs, couches, car seats) are often at least partially formed from textiles. These textiles are often formed by weaving or interlooping (e.g., knitting) a yarn or a plurality of yarns, usually through a mechanical process involving looms or knitting machines. One particular object that may be formed from a textile is an upper for an article of footwear.

Conventional articles of footwear generally include two primary elements: an upper and a sole structure. The upper is secured to the sole structure and forms a void within the article of footwear for comfortably and securely receiving a foot. The sole structure is secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and forms a ground-engaging portion of the sole structure that is formed from a durable and wear-resistant material.

The upper of the article of footwear generally extends over the instep and toe areas of the foot, along the medial and lateral sides of the foot, and around the heel area of the foot. Access to the void on the interior of the upper is generally provided by an ankle opening in a heel area of the footwear. A lacing system is often incorporated into the upper to adjust the fit of the upper, thereby facilitating entry and removal of the foot from the void within the upper. The upper may include a tongue that extends under the lacing system to enhance adjustability of the footwear, and the upper may incorporate a heel counter to limit movement of the heel.

For certain activities, purposes and/or applications, it may be advantageous to provide an upper for an article of footwear that has certain desirable characteristics and properties. In order to impart the different properties to different areas, one or more yarns and/or material elements may be selected for forming the upper. In one example, it may be desirable to provide a knitted upper that is lightweight, while also breathable, durable, at least partially translucent and of high strength and containment. The upper may further include one or more additional optional elements or components that provide other desirable characteristics, including, but not limited to an inlaid component that may enhance comfort and fit, as well as provide enhanced gripping surfaces for certain activities including but not limited to skateboarding, soccer, climbing and the like where traction on at least a portion of the exterior surface of the footwear is desirable. It may also be advantageous to remove at least a portion of the mechanical stretch from a knitted component before forming the knitted component into an upper for an article of footwear. Thus, stretching the knitted component and subjecting it to a pre-determined post-processing method to retain the knitted component in a stretched condition for forming into an upper may also be desirable.

DESCRIPTION OF THE DRAWINGS

The embodiments will be further described in connection with the attached drawings. It is intended that the drawings included as a part of this specification be illustrative of the exemplary embodiments and should in no way be considered as a limitation on the scope of the present disclosure. Indeed, the present disclosure specifically contemplates other embodiments not illustrated but intended to be included in the claims.

DETAILED DESCRIPTION

Figure 1:
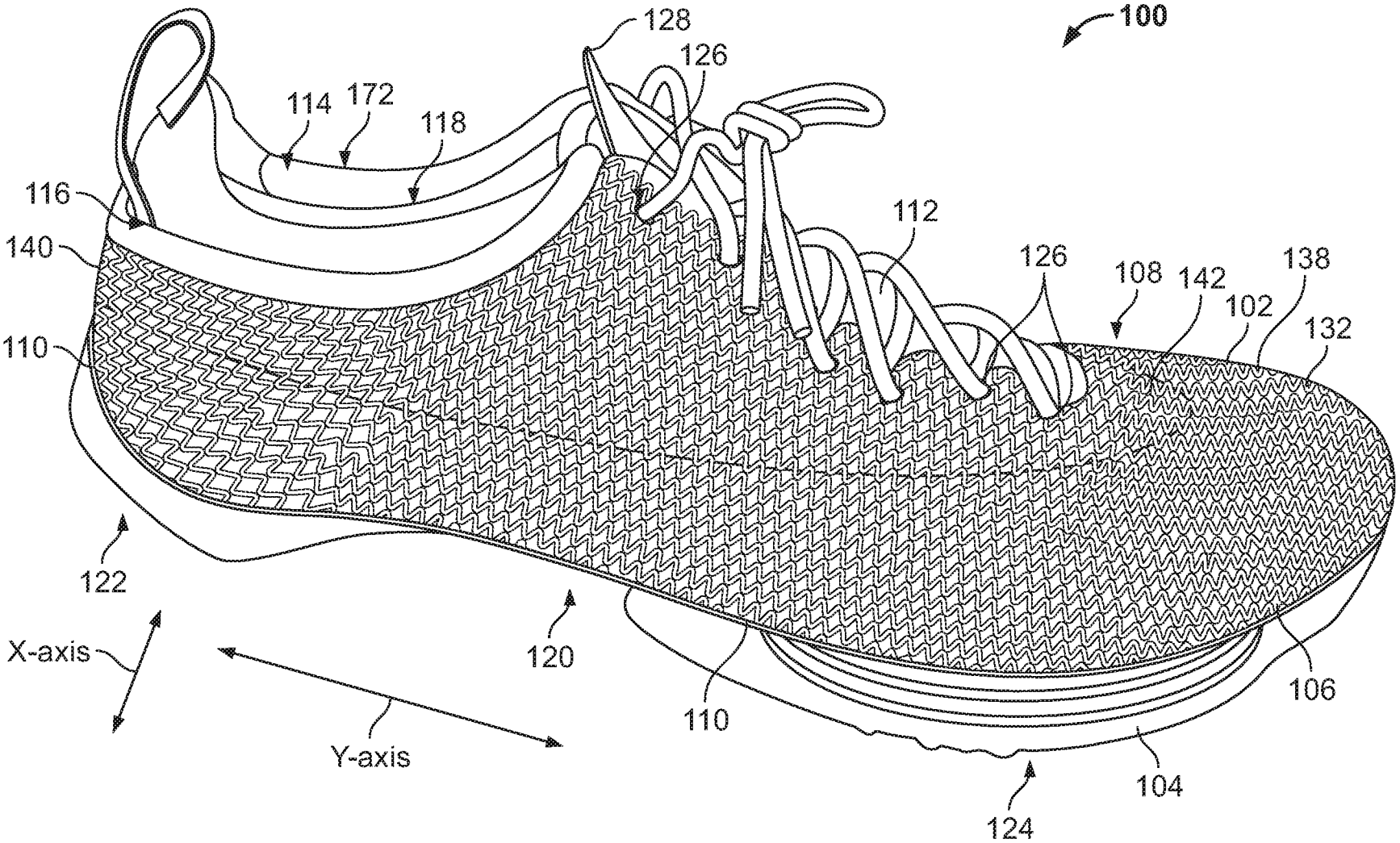
FIG. 1 is an illustration showing a side view of one embodiment of an article of footwear in accordance with certain aspects of the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

Certain aspects of the present disclosure relate to articles at least partially formed from textiles. One example of an article is an article of apparel (e.g., shirts, pants, socks, footwear, jackets and other outerwear, briefs and other undergarments, hats and other headwear, or the like). The article may be an upper configured for use in an article of footwear. The upper may be used in connection with any type of footwear. Illustrative, non-limiting examples of articles of footwear include a skateboarding shoe, a climbing shoe, a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, and a walking shoe. The upper may also be incorporated into a non-athletic shoe, such as a dress shoe, a loafer, and a sandal.

Referring to FIG. 1, an article of footwear 100 may include an upper 102 secured to a sole structure 104. The upper 102 may include a lateral side 106 and a medial side 108. The area of the shoe where the sole structure 104 joins the upper 102 may be referred to as the biteline 110. The upper 102 may be joined to the sole structure 104 in a fixed manner using any suitable technique, such as through the use of an adhesive, by sewing, etc. It is contemplated that the upper 102 may extend partially or completely around the foot of a wearer and/or may be integral with the sole, and a sockliner may or may not be used. In some embodiments, the sole structure 104 may include a midsole (not shown) and an outsole.

The article of footwear 100 may additionally include a throat area 112 and an ankle opening 114, which may lead to a void 118. The void 118 of the article of footwear 100 may be configured to accommodate a foot of a person. The throat area 112 may be generally disposed in a midfoot area 120 of the upper 102. The midfoot area 120 is generally an area of the upper 102 located between a heel area 122 and a toe area 124. In some embodiments, a tongue may be disposed in the throat area 112, but a tongue is an optional component. The tongue may be any type of tongue, such as a gusseted tongue or a burrito tongue. The article of footwear shown in FIGS. 1 and 2 preferably includes a tongue that is integrally formed with the upper, such that the upper and the tongue are one piece and no separate attachment of a tongue component is necessary. However, in an embodiment where a tongue is not included, a tongue may be separately formed and later joined to the upper such as by adhesives, bonding and/or stitching, or, in yet another embodiment where no tongue is included, the lateral and medial sides of the throat area 112 may be joined together. As shown, in some embodiments, the article of footwear 100 may include an optional fastening element, such as a lace (which may be associated with a plurality of lace apertures 126). The apertures may extend from a forefoot region, through a midfoot region and toward the throat area 112. Any suitable type of fastening element may be used.

At least a portion of the upper 102, and in some embodiments substantially the entirety of the upper 102, and in still further embodiments the entire upper, may be formed of at least one knitted component 132, such as a weft-knitting process on a flat knitting machine, for example. The knitted component 132 may additionally or alternatively form another element of the article of footwear, such as an underfoot portion, for example, and/or a heel element 134 as will be described in further detail below. Alternatively, a second or additional knitted component 136, separately formed from knitted component 132, may form another element of the article of footwear, such as an underfoot portion, for example, and/or a heel element 134. In other words, additional elements such as an underfoot portion and/or a heel element 134 (or other elements or components) may be integrally formed with the upper 102 as a one-piece structure, or, alternatively, one or more such additional elements may be formed separately from the upper 102 and then later attached, secured or otherwise assembled as necessary.

The knitted component 132 may have a first side 130 forming an inner surface of the upper 102 (e.g., facing the void 118 of the article of footwear) and a second side 138 forming an outer surface of the upper 102 (e.g. facing generally opposite the first side 130). The first side 130 and the second side 138 of the knitted component 132 may exhibit different characteristics (e.g., breathability, gripping ability, abrasion resistance, strength, structure and comfort, among other advantageous characteristics mentioned herein). As previously mentioned, the knitted component 132 may be formed as an integral one-piece element during a knitting process, such as a weft knitting process (e.g., with a flat knitting machine or circular knitting machine), a warp knitting process, or any other suitable knitting process. That is, the knitting process on the knitting machine may substantially form the knit structure of the knitted component 132 without the need for significant post-knitting processes or steps. Alternatively, two or more portions of the knitted component 132 may be formed separately as distinct integral one-piece elements and then the respective elements attached. For example, the heel element 134 can be knitted separately from the upper 102 and then attached or secured to the upper 102 by adhesives, stitching, bonding or other mechanisms or a combination thereof. Additional portions or details may also be secured or attached to the upper for structural or aesthetic purposes, including heel reinforcements, lace aperture reinforcements, to reinforcements and the like. These additional portions may be formed of a separate knitted component that is later attached or by other textiles or materials including, but not limited to leather, suede, rubber, plastic and others.

Forming the upper 102 with the knitted component 132 may provide the upper 102 with advantageous characteristics including, but not limited to, a particular degree of elasticity (for example, as expressed in terms of Young's modulus), grip, breathability, bendability, strength, moisture absorption, weight, abrasion resistance, and/or a combination thereof. These characteristics may be accomplished by selecting a particular single layer or multi-layer knit structure (e.g., a ribbed knit structure, a single jersey knit structure, or a double jersey knit structure), by varying the size and tension of the knit structure, by using one or more yarns formed of a particular material (e.g., a polyester material, a relatively inelastic material, or a relatively elastic material such as spandex), by selecting yarns of a particular size (e.g., denier), and/or a combination thereof. The knitted component 132 may also provide desirable aesthetic characteristics by incorporating yarns having different colors, reflectivity, textures, various degrees of transparency or translucency or other visual properties arranged in a particular pattern. In addition to incorporating different yarns, other materials may be incorporated into the knitted component including but not limited to leather, suede, rubber, plastic or other materials.

The yarns themselves and/or the knit structure formed by one or more of the yarns or other materials of the knitted component 132 may be varied at different locations such that the knitted component 132 has two or more portions with different properties. In one non-limiting example, at least a portion of the knitted component 132 may be formed by one or more yarns and/or knitting techniques to provide an upper 102 that is lightweight, having relatively high strength and containment and also breathable. Other areas of the upper 102 formed by the knitted component 132 may be formed by one or more different yarns and/or formed by different knitting techniques and/or other materials that result in a portion of the upper 102 that has different characteristics. For example, the yarn(s) and/or the knitting techniques used to form the throat area 112 and/or the ankle opening 114 may be selected to provide relatively greater elasticity, soft hand, cushioning, enhanced comfort and moisture wicking properties to those regions. In some embodiments, the knitted component 132 may incorporate one or more materials with properties that change in response to a stimulus (e.g., temperature, moisture, electrical current, magnetic field, or light). In still other embodiments, the knitted component 132 may incorporate one or more materials that provide other desirable characteristics including but not limited to enhanced gripping surfaces.

For example, the knitted component 132 may include one or more yarns formed of a thermoplastic polymer material (e.g., polyurethanes, polyamides, polyolefins, and nylons) that transitions from a solid state to a softened or liquid state when subjected to certain temperatures at or above its melting point and then transitions back to the solid state when cooled. The thermoplastic polymer material may provide the ability to heat and then cool a portion of the knitted component 132 to thereby form an area of fused or bonded or continuous material that exhibits certain advantageous properties including a relatively high degree of rigidity, strength, and water resistance, for example. Other advantages of providing one or more yarns comprising a thermoplastic polymer material may include, for example, locking or securing the yarns of the knitted component into a particular position or configuration upon cooling, such that the knitted component 132 may be retained in that particular configuration. In one non-limiting example, this may include stretching the knitted component to a predetermined degree and then heating the knitted component 132 during a post processing method, such as steaming. Upon cooling, the fusible yarns may lock the adjacent and/or surrounding yarns in the stretched configuration to retain the knitted component 132 in this stretched condition. The knitted component 132 may also include one or more yarns having a relatively high degree of tenacity relative to the other yarns used to form the upper.

As used herein, "tenacity" is understood to refer to the amount of force (expressed in units of weight, for example: pounds, grams, centinewtons or other units) needed to rupture a yarn (i.e., the breaking force or breaking point of the yarn), divided by the linear mass density of the yarn expressed, for example, in (unstrained) denier, decitex, or some other measure of weight per unit length. The amount of force needed to break a yarn (the "breaking force" of the yarn) is determined by subjecting a sample of the yarn to a known amount of force by stretching the sample until it breaks, for example, by inserting each end of a sample of the yarn into the grips on the measuring arms of an extensometer, subjecting the sample to a stretching force, and measuring the force required to break the sample using a strain gauge load cell. Suitable testing systems can be obtained from Instron (Norwood, Mass., USA). Yarn tenacity and yarn breaking force are distinct from burst strength or bursting strength of a textile, which is a measure of the maximum force that can be applied to the surface of a textile before the surface bursts.

Generally, in order for a yarn to withstand the forces applied in an industrial knitting machine, the minimum tenacity required is approximately 1.5 grams per denier (g/D). Most synthetic polymer continuous filament yarns formed from commodity polymeric materials generally have tenacities in the range of about 1.5 g/D to about 4 g/D. For example, polyester filament yarns that may be used in the manufacture of knit uppers for article of footwear have tenacities in the range of about 2.5 g/D to about 4 g/D. Filament yarns formed from commodity synthetic polymeric materials which are considered to have high tenacities generally have tenacities in the range of about 5 g/D to about 10 g/D. For example, commercially available package dyed polyethylene terephthalate filament yarn from National Spinning (Washington, N.C., USA) has a tenacity of about 6 g/D, and commercially available solution dyed polyethylene terephthalate filament yarn from Far Eastern New Century (Taipei, Taiwan) has a tenacity of about 7 g/D. Filament yarns formed from high performance synthetic polymer materials generally have tenacities of about 11 g/D or greater. For example, filament yarns formed of aramid typically have tenacities of about 20 g/D, and filament yarns formed of ultra-high molecular weight polyethylene (UHMWPE) having tenacities greater than 30 g/D are available from Dyneema (Stanley, N.C., USA) and Spectra (Honeywell-Spectra, Colonial Heights, Va., USA).

It is also contemplated that the knitted component may also include one or more yarns having relatively high elasticity. Suitable elasticated yarns may incorporate elastane fiber(s), such as those available from Invista Company under the LYCRA trademark. Such yarns may have the configuration of covered LYCRA, for example yarns having a LYCRA core that is surrounded by a nylon sheath. Other fibers or filaments exhibiting elastic properties may also be utilized.

Figure 11:
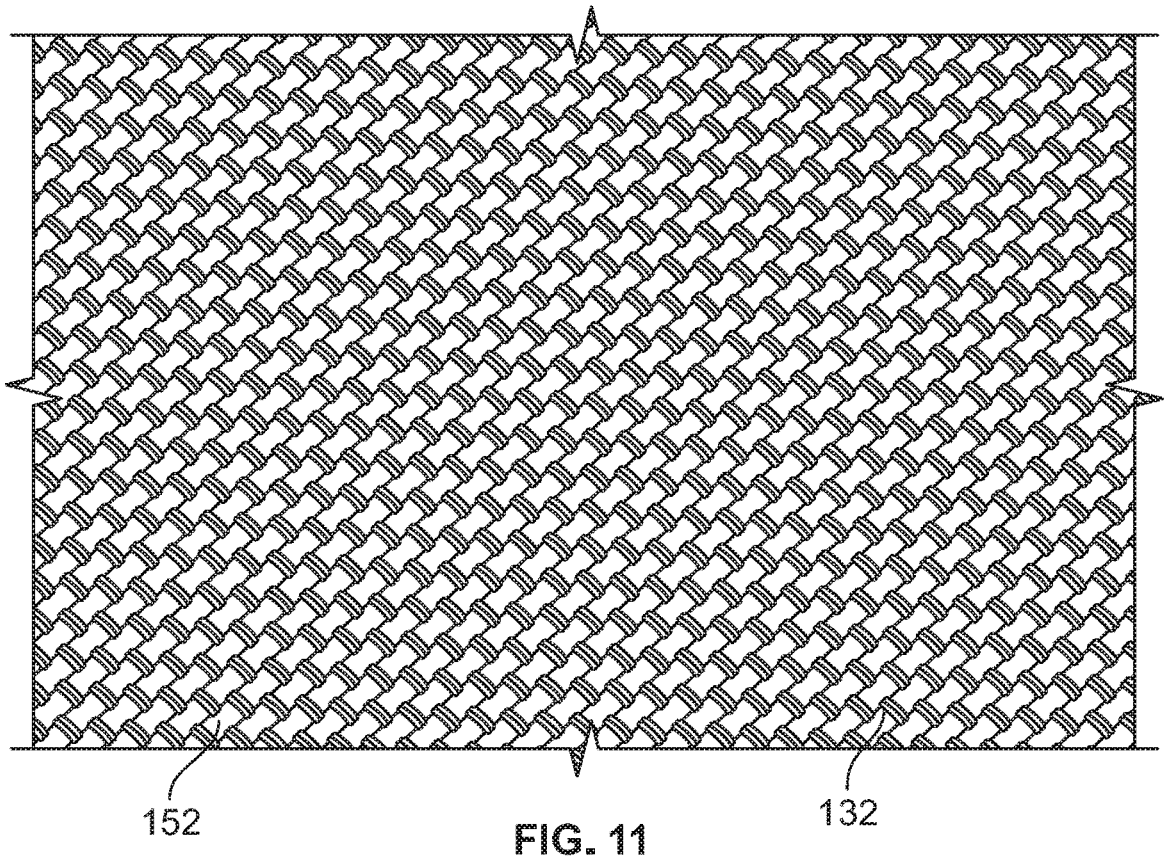
FIG. 11 is an illustration showing one example of a knitted component having an inlaid component in accordance with certain aspects of the present disclosure.
Figure 12:
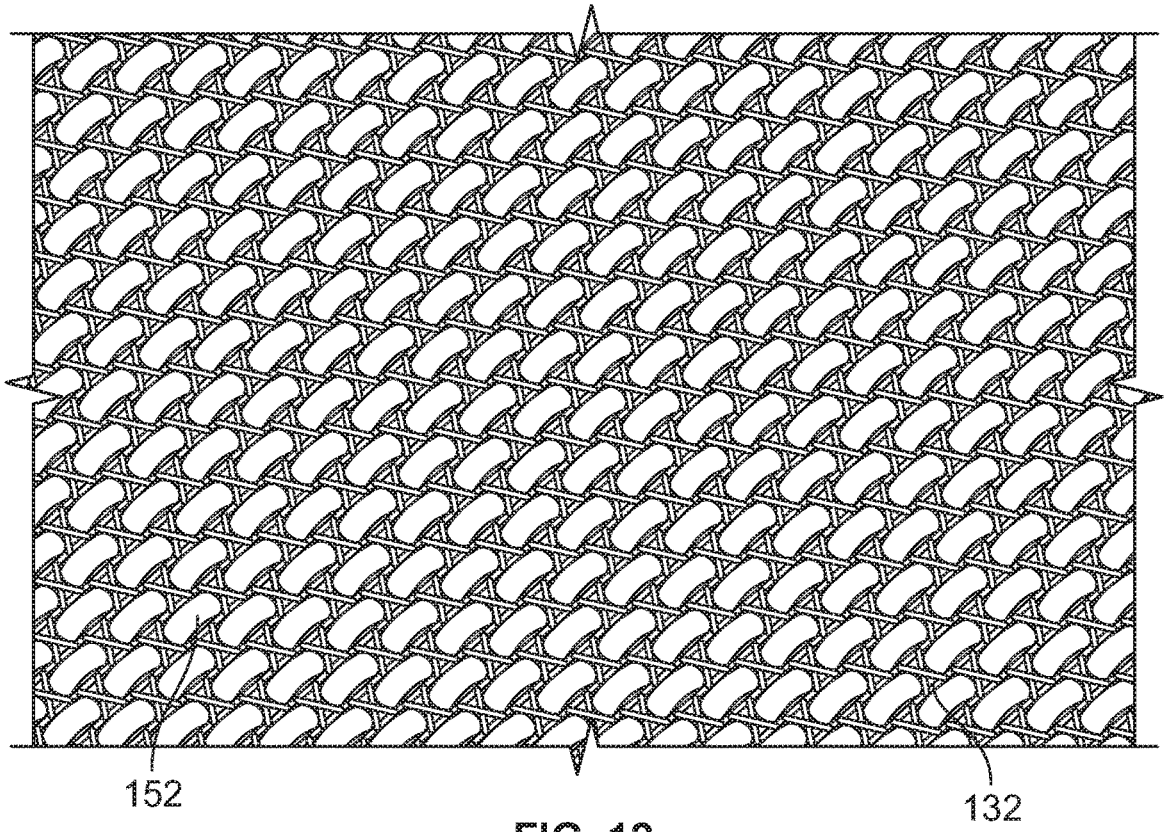
FIG. 12 is an illustration showing an enlarged view of a portion of the knitted component of FIG. 2.
Figure 13:
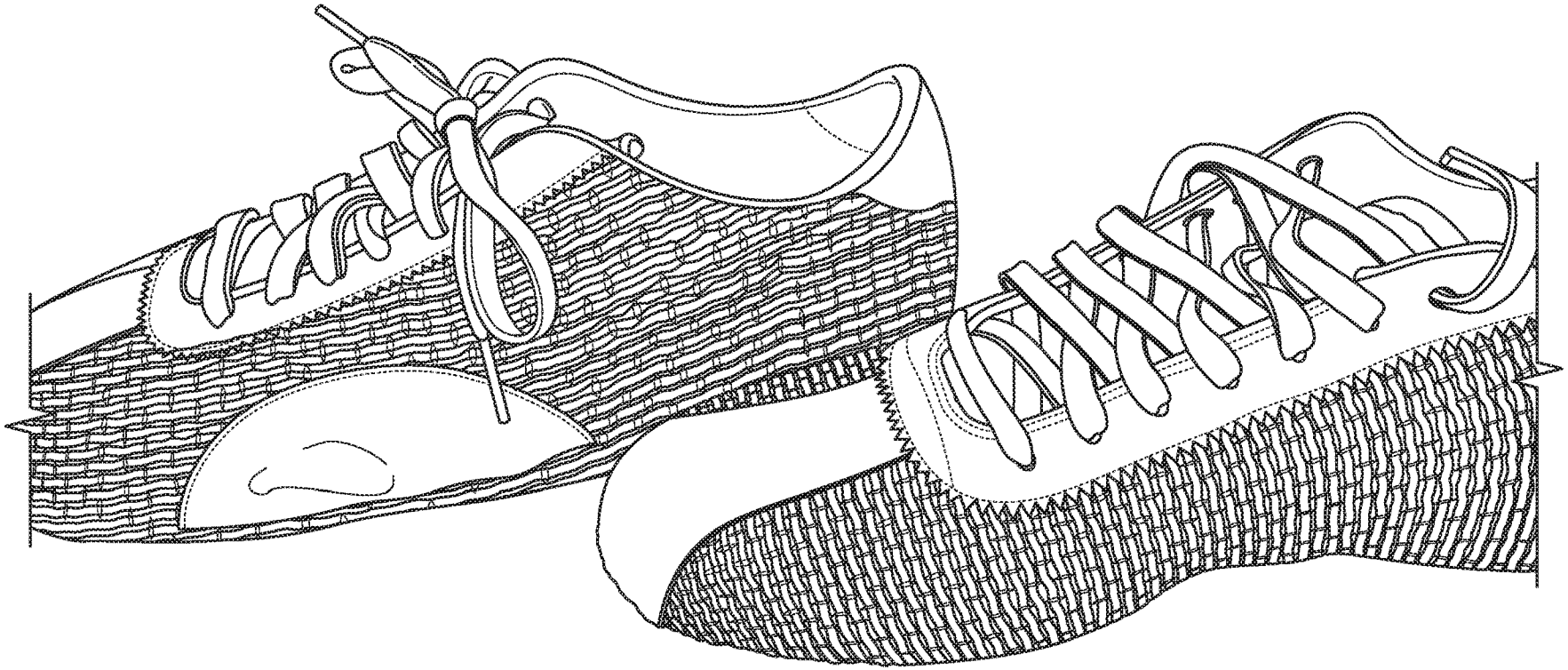
FIG. 13 is an illustration showing two examples of an article of footwear, each having a different combination of colors, each having a knit upper with an inlaid component in accordance with certain aspects of the present disclosure.

The knitted component 132 may also incorporate additional materials or components. In some non-limiting examples (such as the examples of FIGS. 10-13), the knitted component 132 may incorporate an inlaid component 152. The inlaid component 152 may comprise one or more yarns, rubbers, plastics, leathers and/or other natural or synthetic components. As shown generally in FIG. 11, the knitted component 132 (which may be incorporated into an article of footwear 204) may include an inlaid component 152 that extends generally in a heel to toe direction when the knitted component 132 is incorporated into an article of footwear. In another example (also shown in FIG. 11 along with FIG. 12), the inlaid component 152 may extend generally in a lateral to medial direction, and/or vertically when an associated article of footwear 206 is sitting on horizontal ground in a wearable state. In still another example, the inlaid component 152 may extend in multiple directions and/or may be located in certain portions of the upper 102 and be absent from other areas of the upper 102. Such an arrangement may provide regional properties to certain portions of the upper, such that certain advantageous properties may deliberately be provided to certain parts of the upper while deliberately omitting certain properties from other parts of the upper 102.

The knitted component 132 may include a seamless portion extending from the toe area 124, through a midfoot area 120, and to a heel area 122 on at least one of a lateral side 106 and a medial side 108 of the upper. In some embodiments, the knitted component 132 may include a first edge and a second edge, which may be terminal ends of the knitted component 132 after the knitting process when the knitted component 132 is removed from the knitting machine. After the knitting process, the knitted component 132 may be folded or otherwise manipulated such that a first edge and the second edge are secured together at a seam 140 during formation of the upper 102. The seam 140 may be located on the lateral side 106 of the upper 102, on the medial side 108 of the upper 102, and/or in another location (e.g., at the back of the heel area 122 of the upper as shown in FIG. 1). Forming the upper 102 such that it is in an appropriate shape for inclusion in an article of footwear 100 may further include lasting the upper 102. An example of a lasting process is described in U.S. patent application Ser. No. 12/848,352, filed Aug. 2, 2010, and issued as U.S. Pat. No. 8,595,878, which is herein incorporated by reference in its entirety.

When forming the knitted component 132, the knitted component 132 may be oriented with respect to a needle bed of a knitting machine such that a feeder of the knitting machine is capable of moving in a single pass (i.e., without changing its feed direction) to knit a first course from the lateral side 106 to the medial side 108 of the knitted component. As such, as subsequent courses are formed that are parallel to the first course, the toe area 124 of the knitted component 132 will be formed first, followed by the midfoot area 120 of the knitted component 132, and then the heel area 122 of the knitted component 132 (and/or vice versa, such that the knitted component is formed along a y-axis, in a heel-to-toe direction). Alternatively, the knitted component 132 may be oriented with respect to a needle bed of a knitting machine such that a first course is knit in a direction from heel to toe (or toe to heel). As such, when additional courses are formed parallel to the first course, one of the lateral or medial side is formed first, followed by a central portion such as the throat followed by the other of the lateral or medial side. As such, the knitted component is formed along an x-axis, in a side-to-side, or lateral-to-medial direction.

In one embodiment, the inlaid component 152 may be generally parallel to the course-wise direction of the knitted component 132. In an alternative embodiment, the inlaid component 152 may be generally perpendicular to the course-wise direction of the knitted component 132. It is also contemplated that the inlaid component 152 may be oriented in a particular direction in a forefoot and/or midfoot area of the upper 102 and be oriented in a different direction in a heel area of the upper 102, for example.

As shown in FIGS. 1-4, at least a portion of the upper 102 may comprise a single layer 142. As such, an outer surface (the second side 138) of the single layer 142 may form an external surface of an upper 102 and the inner surface (the first side 130) of the single layer 142 may form an inner surface of the upper 102, facing the void 118 of the upper configured to receive the foot of a wearer.

In an alternative embodiment, one or more portions of the upper 102 may comprise more than a single layer 142, such as a first layer and a second layer that are coextensive and/or overlapping, which may form a pocket therebetween. The pocket may be filled with another element (e.g., a filler material, such as foam, down, or another suitable material or object), but this is not required, and in exemplary embodiments, the pocket may be empty and/or filled with just air.

As mentioned above, the upper 102 may comprise an ankle opening 114, which leads to the void 118, configured to accommodate a foot of a wearer. The ankle opening 114 may be formed of one or more collars. The collar 116 of the upper 102 may be referred to herein as a "first collar" which forms a "first collar opening." The one or more of the yarns and/or knitting techniques used to form the collar 116 may be the same as the yarns and/or knitting techniques used to form other portions of the upper 102 or they may be different.

Figure 2:
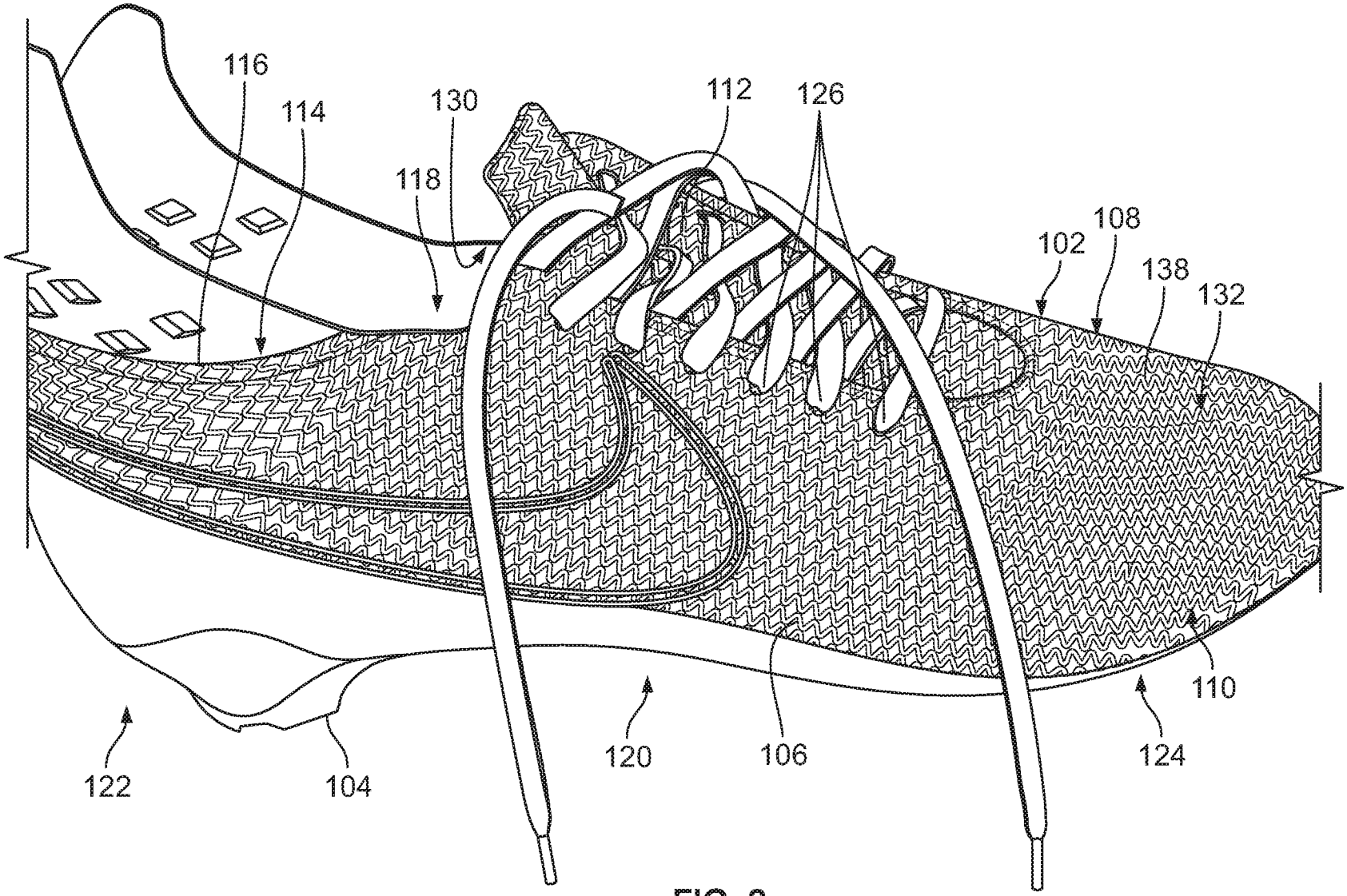
FIG. 2 is an illustration showing a perspective view of another embodiment of an article of footwear in accordance with certain aspects of the present disclosure.
Figure 3:
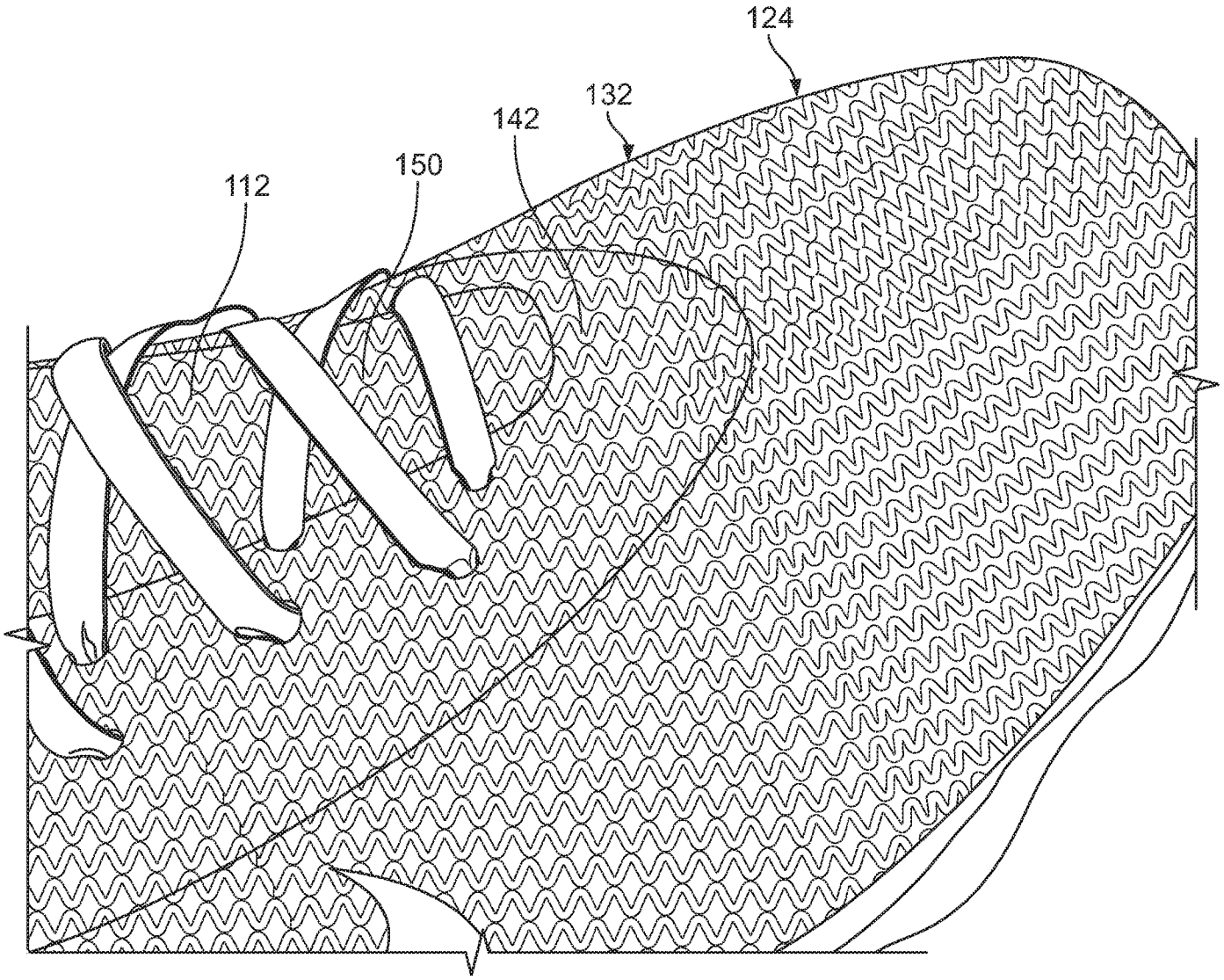
FIG. 3 is an illustration showing an enlarged view of a toe region of the article of footwear of FIG. 1.

For example, as shown in FIGS. 1-3, the one or more yarn(s), as well as the one or more knitting technique(s) used to form the collar 116, the throat area 112 and the remainder of the upper 102, respectively, may differ in order to impart desired properties and characteristics to different regions of the upper 102 as described below.

One or more yarns may be used when knitting the knitted component 132 that is formed into an upper 102. In one non-limiting example, a first yarn 144 may include a high tenacity polyester yarn. In one non-limiting example, the high-tenacity polyester yarn may be formed from polyethylene terephthalate (PET). The first yarn 144 may have a tenacity of at least 5 grams per denier, and more preferably higher than 6 grams per denier and even more preferably from 6.5-7 grams per denier. In one example, three ends of 300 denier high tenacity polyester yarn may be used. The high tenacity polyester may be translucent or at least partially transparent in some embodiments. This may allow one or more images, elements, symbols, logos or other objects that are behind portions of the knitted component 132 formed from the first yarn 144, (such as images or elements that are adjacent to the inner surface or first side 130 of the upper 102 and/or within the void 118 formed by the upper 102, to be visible from the second side 138 or exterior of the upper 102. This may enhance the visual properties and/or aesthetic appearance of the upper 102, for example. It will be recognized that more or fewer ends of the first yarn 144, having lower or higher tenacity and/or lower or higher denier, may be used as one of skill in the art would recognize to achieve the desired and necessary properties.

A second yarn 146 may be used to form at least a portion of the first knitted component 132, alone or in combination with the first yarn 144. The second yarn 146 may be the same as the first yarn 144 or it may be different. In one example, the second yarn 146 may have one or more thermoplastic polymers (collectively "the thermoplastic polymer material"), and in some embodiments, substantially the entirety of the second yarn 146 may be formed of the thermoplastic polymer material. The thermoplastic polymer material of the second yarn may have a melting temperature of between about 80-100 degrees C. and more preferably 85-90 degrees C. based on atmospheric pressure at sea level, though any other suitable melting temperatures is contemplated. In a non-limiting example, the second yarn 146 may be referred to as a "fusible yarn" sold under the trade name Grilon K-85 by EMS-Griltech. The K-85 yarn is a multifilament yarn where the polymer basis is a copolyamide. It should also be noted that a yarn with a melting temperature below 140 degrees C. that can be melted/post processed by steaming, heat and/or pressing to bind or fuse with the surrounding (non-low melt) yarns and hold them in place may be referred to as a 'fusible' or 'low melt' yarn herein. In one example, two ends of 235 denier of the second yarn 146 may be used. Alternately, fewer ends of a higher denier second yarn 146 may be used, such as one end of a 500 denier yarn. More or fewer ends of the second yarn 146 having lower or higher denier or lower or higher melting temperature may be used as one of skill in the art would recognize to achieve the desired and necessary properties.

A third yarn 148 may be used to form at least a portion of the knitted component 132, alone or in combination with the first yarn 144 and/or the second yarn 146. In one example, the third yarn 148 may also be a high tenacity polyester yarn formed from polyethylene terephthalate (PET). The third yarn 148 may sometimes be referred to herein as a high tenacity sewing thread or "M-60" and/or sold under the trade name "Graf" by Coats Group PLC. The term "thread" in reference to the third yarn 148 may infer to one of skill that this yarn has an increased amount of twist to keep the filaments tighter/more compact, often useful for going smoothly and efficiently through sewing or knitting needles. In the present case, the third yarn 148 (e.g. high tenacity polyester sewing thread) may provide a different aesthetic as compared to the first yarn 144 (e.g. also a high tenacity polyester yarn). The third yarn 148 may have a tenacity of at least 5 grams per denier, and in some examples approximately 6-8 grams per denier and more preferably approximately 7.5 grams per denier. In one example, one end of the third yarn 148 may be used, but it will be recognized that more or fewer ends of the third yarn 148, having lower or higher tenacity and/or lower or higher denier, may be used as one of skill in the art would recognize to achieve the desired and necessary properties.

The high tenacity yarns, including the first yarn 144 (i.e. the high tenacity polyester yarn) and/or the third yarn 148 (i.e. the high tenacity polyester sewing thread) may be knit alone or in combination with other yarns, such as the second yarn 146 (the fusible yarn). For example, the high tenacity polyester yarns 144, 148 may be knit in combination with the fusible yarn 146 mentioned above. The combination of yarns as well as the knitting technique used to form the upper 102 is described in further detail below.

In addition to the first, second and third yarns 144, 146, 148, a fourth yarn 150 may be used to form the knitted component 132. The fourth yarn 150 may be the same as the first, second and/or the third yarn 144, 146, 148, or it may be different. In one example, the fourth yarn 150 used to form at least a portion of the knitted component 132 comprises a yarn that is different than the first, second and third yarns 144, 146, 148 and comprises a relatively more elastic yarn than the aforementioned first, second and third yarns. In one example, the fourth yarn 150 may comprise a combination of a polyester yarn with an elastic core. In some embodiments, the fourth yarn 150 may be referred to as "E08" which may be two strands of a textured polyester yarn wrapped about an elastic (i.e. a 420D Spandex) core. Other suitable elastic yarns may also include "E06" which may be two strands of textured polyester wrapped around a 140D Spandex core or "E04" which may be two strands of textured polyester wrapped around a 210D Spandex core, although other suitable elastane yarns may be used to achieve the necessary properties and characteristics. The combination of materials, such as the polyester yarn and the elastic yarn that together form the fourth yarn 150 may be achieved by twisting, winding, braiding, and/or wrapping on about the other and the like, and/or the yarns may be a core/sheath configuration, and/or the yarns may be tacked along their length at a plurality of points.

During the knitting process, another yarn and/or material may be inlaid within the knitted component 132. This inlaid component 152 (FIGS. 10-13) may be the same as one or more of the first, second, third or fourth yarns. Alternatively, the inlaid component 152 may be another material including leathers, rubbers, plastics, nylon and/or other natural and/or synthetic materials or combinations thereof. The material of the inlaid component 152 may be selected depending on the structural or aesthetic or advantageous characteristic that is desired. In one non-limiting example, the inlaid component 152 may include a natural material such as leather, or a synthetic material such as synthetic leather. The inlaid component 152 may be in the form of a strip or cord or other type of elongated structure.

During or after the knitting process, a stimulus, such as heat, may be applied to at least a portion of, or to the entirety of the upper 102. This heat may be in the form of steam, such as by a steam-providing device, for example. One or more effects may result from the exposure of the knitted component 132 to steam.

In one example, the steam may cause one or more of the yarns used to form the knitted component 132 to melt into a softened or liquid state. For example, the steam may cause the second yarn 146 (the thermoplastic yarn, or "fusible yarn," for example) having a melting temperature of 85 degrees C., to soften or become molten or enter into a relatively liquid state when the temperature reaches or exceeds the designated melting temperature of the yarn. When subjected to a stimulus, such as steam heat and/or pressure, the thermoplastic polymer material included with the second yarn 146 described above, may at least partially melt.

In one example, the steam may activate thermoplastic polymer materials in the second yarn 146. Once this heat is removed and the article cools, the thermoplastic material present in the second yarn 146 may at least partially fuse together with adjacent or surrounding yarns in its proximity within the knitted component 132. In other words, the second yarn 146 may infiltrate and/or permeate any of the adjacent or surrounding knit loops and/or courses of the knitted component 132 formed from any of the other yarns used to form the knitted component 132 and/or the inlaid component 152. As a result, the at least a portion of one or more of the separate yarns originally forming the knitted component 132 (and/or the inlaid component 152) may become bonded and/or continuous with the second yarn 146 to form a "fused" area. There may be fewer and relatively large fused areas in one or more portions of the upper, or there may be a plurality of relatively small fused areas throughout the upper. In some instances, the fused area may be small enough or they may be at least partially translucent or transparent such that they are not readily visible. When the thermoplastic material transitions back to a solid state upon cooling, this may cause the fused yarns to remain fixed in (or at least have a tendency to remain fixed in) a desirable position and orientation. Heat-processing the fusible material of the fusible yarn may also enhance the rigidity, strength, and other mechanical properties of the knitted component at least in select locations and/or have the effect of securing or locking the relative positions of the yarns within the knitted component 132.

As shown in FIG. 1, at least a portion of the knitted component 132 forming the upper 102, and more preferably, a majority of (i.e. greater than 50%) or even more preferably a substantial majority (i.e. greater than 75% or more) of the knitted component is formed from the first, second and third yarns 144, 146, 148. The inlaid component 152 (FIGS. 10-13) may be incorporated into the portion of the knitted component 132 formed from the first, second and third yarns 144, 146, 148. Hereinafter, the portion of the upper 102 formed from the first, second and third yarns 144, 146, 148, which, in one example, is the upper excluding the throat area 112 and/or the first collar 116, will be referred to as the "body" 154 of the upper 102. Stated differently, the body 154 of the upper 102, with the exception of the throat area 112 and/or the collar 116, is formed from the first, second and third yarns, 144, 146, 148 and/or the inlaid component 152, while the throat area 112 and/or the collar 116 are formed at least in part from the fourth yarn 150. It is also contemplated, however, that one or more of the first, second and/or third yarns 144, 146, 148 may be present in lieu of, or in combination with, the fourth yarn 150 in the throat area 112 and/or the collar 116. The inlaid component 152 may also be incorporated into the throat area 112 and/or the collar 116.

As previously mentioned, different characteristics and advantageous properties may be imparted to different areas or regions of the upper. This may be accomplished by not only selecting a particular yarn or yarns to form different regions of the upper 102. However, this may also be accomplished by selecting a particular knitting technique, selecting single layer or multi-layer knit structure (e.g., a ribbed knit structure, a single jersey knit structure, or a double jersey knit structure), by varying the size and tension of the knit structure, by using one or more yarns formed of a particular material (e.g., a polyester material, a thermoplastic material, a relatively inelastic material, or a relatively elastic material such as spandex, etc.), by selecting yarns of a particular size (e.g., denier), and/or a combination thereof. In one example, the first, second and third yarns 144, 146, 148 forming the body 154 of the upper 102 may be knit using a particular knitting technique to achieve a particular knit density, for example, including but not limited to a half-gauge knit (knitting on every other needle of a knitting machine). This may include a half-gauge jersey knit as shown in FIG. 1 and FIG. 3, for example. It is also contemplated that the body 154 of the upper 102 may be formed from a lesser gauge knit, including but not limited to a third gauge knit (knitting on every third needle) or quarter gauge knit (knitting on every fourth needle).

As such, in some embodiments, the body 154 of the upper 102 may have a different stitch density than other portions, such as the throat area 112 and/or the collar 116. For example, the body 154 may have a half gauge stitch density or less-than half gauge stitch density. As used in this application, the terms "full gauge," "half gauge," and "less than full gauge," may generally refer to the stitch density of a knit component. Generally, a knit component may include an area having a "full gauge" stitch density if that area contains stitches (e.g., loops or tucks) formed on at least two consecutive needles of a needle bed (often more than two consecutive needles). Similarly, the same knit component may include an area having a "half gauge" stitch density, in which that area contains stitches formed on every other needle. Similarly, the same knit component may have "less than full gauge" areas that are neither full gauge nor half gauge, for example one-third gauge (stitches formed on every third needle) or one-quarter gauge (stitches formed on every fourth needle).

The relatively lower density knit structure provided by the half-gauge knitting technique may therefore provide a lightweight, breathable upper. Additionally, any one or more of the first, second, third and/or fourth yarns 144, 146, 148, 150 used to knit the upper 102 may be at least partially translucent and/or transparent either before and/or after any post-processing steps such as exposure to a stimulus (i.e. steam or other heat). Accordingly, the relatively low density of the knit combined with the translucency or transparency of one or more of the yarns used to form the knitted component 132 may result in the upper 102 also being at least partially translucent and/or transparent. This may reveal, display or otherwise show any auxiliary elements or components or other features (such as logos, decorative elements, colors, etc.) that may lie behind or underneath the first side 130 (the inner surface of the knitted component 132) and/or within the void 118. This may also allow the inlaid component 152 to be readily apparent, this providing an additional desirable aesthetic appearance to the upper 102 in addition to other advantages that may be provided by the inlaid component 152.

This is shown, for example, in FIGS. 1 and 2. Placement of an additional or auxiliary element 156 within the void 118, adjacent a first side 130, is visible from the exterior of the footwear. FIG. 1 shows an auxiliary element 156 that extends at least partially around a lower perimeter of the article of footwear 100, such as near the biteline 110 where the upper 102 meets and/or joins the sole structure 104. While the auxiliary element 156 is shown generally as a band or a strip, the auxiliary element 156 may be of any shape, length, size and/or dimension. In another example shown in FIG. 2, the auxiliary element 156 is a band that extends generally between the lateral and medial sides 106, 108 of the upper 102, over the top of the foot in the toe area 124. The auxiliary element 156 may be formed from a knit structure or a non-knit structure, including but not limited to other textiles, rubbers, plastics, metals, cables, foams and/or padding. The auxiliary element 156 may be integrally formed with the upper 102 during the knitting process or it may be formed separately and later attached to the upper 102 such as by stitching, bonding, adhesives or other suitable attachment mechanisms. In one example, the auxiliary element 156 may provide enhanced structure, support, rigidity, water repellency, comfort, strength or other advantageous properties to the article of footwear 100. Additionally or alternatively, the auxiliary element 156 may enhance the aesthetic visual and design properties of the upper, such as by providing additional colors, shine, reflectivity and allow the display of logos, placards, emblems and insignia as desired.

As described in further detail below with reference to the knit diagram shown in FIG. 7, the body 154 of the upper 102 may be formed by a series of courses of the first, second and third yarns 144, 146, 148. In one non-limiting example, a first course may be knit with a combination of the first yarn 144 (e.g., the high tenacity polyester yarn) and the second yarn 146 (e.g., formed thermoplastic polymer material, the "fusible yarn"). A second consecutive course may be formed from a combination of the third yarn 148 (e.g., the high tenacity polyester "sewing thread") and the second yarn 146 (e.g., formed thermoplastic polymer material, the "fusible yarn"). This pattern of yarn selection may be repeated, knitting on every other needle of a needle bed, to form a half-gauge knit body 154 for the upper 102. It is noted that the use of one or more relatively high tenacity yarns, including the first yarn 144 (e.g., the high tenacity polyester yarn) and/or the third yarn 148 (e.g., the high tenacity polyester "sewing thread") may provide the advantage of an upper 102 having relatively high strength and containment (e.g. "lock in" of a wearer's foot) even when knit as a relatively less dense, single layer, half-gauge structure using every other needle (as compared to a more densely knit structure formed as a "full gauge knit" using every needle of a knitting machine).

It is also contemplated that during the knitting process, the knitting machine may include an additional feeder that includes the component to be inlaid. For example, a feeder may be provided with (or connected to) a spool or other reservoir containing a leather strip or band. The leather strip may be inlaid within the knitted component 132. Of course, materials other than leather may be inlaid within the knitted component depending on the advantageous characteristic to be achieved, including suede, faux leather, nylon, plastic, rubber and the like. One example of an inlay process that may be used to inlay the inlaid component 152 of FIGS. 10-13 is described in U.S. Pat. No. 8,839,532, which is hereby incorporated by reference in its entirety.

In one example, the inlaid component 152 provides an additional gripping characteristic that is advantageous to the wearer when participating in certain activities, including but not limited to skateboarding, soccer, climbing and the like. More specifically, the properties of the inlaid component 152 preferably provide at least a portion of the outer surface of the upper 102 with a greater or enhanced tackiness and ability to grip or temporarily adhere to another surface, such as a board, ball, wall or other surface. The result may be a greater friction between at least a portion of the upper 102 where the inlaid component 152 is present and the additional surface, such that the user experiences less slippage and feeling of enhanced tactile quality, feedback and control (e.g., "board feel" when referring to skateboarding, for example). Thus, in one example, one or more inlaid components 152 may provide an enhanced grip between the upper 102 and a surface of a skateboard, climbing wall and/or ball. In some embodiments, for example (such as that of FIG. 10), each course of the knitted component 132 may include an inlaid component 152, but this is not required.

As noted above, in addition to the body 154, the upper 102 further includes throat area 112. The knitting technique and/or yarn(s) used to form the throat area 112 may be the same as the knitting technique and/or the yarn(s) used to form the body 154 or the yarn(s) may be different. In one example, the throat area 112 is formed by a different knitting technique than the one used to form the body 154. In one example, the throat area 112 may be a rib structure, a rib structure with mesh, a full gauge jersey, double jersey or other suitable knit structures that may be selected to achieve a desired characteristic. As shown in FIG. 1, the throat area 112 may be a ribbed structure that is a relatively more dense knit structure than the body 154. The throat area 112 may be formed at least in part from the fourth yarn 150 (e.g., the relatively elastic yarn, such as E08 described above, or other relatively elastic yarns). While the throat area 112 may be exclusively knit by the fourth yarn 150, it is also contemplated that one or more of the first, second and/or third yarns 144, 146, 148 may be present in the throat area 112. The relatively high degree of stretch and/or elasticity provided by the fourth yarn 150 imparts stretch to the throat area 112 that may provide ease of entry of a wearer's foot into the void while also allowing the upper to conform to the foot when worn, and enhance comfort and fit.

As noted above, in addition to the body 154 and the throat area 112, the upper 102 may further include collar 116. The knitting technique and/or yarn(s) used to form the collar 116 may be the same as the knitting technique and/or the yarn(s) used to form the body 154 or the throat area 112, or they may be different. In one example, the collar is formed by a different knitting technique than the one used to form the body 154 and the throat area 112. For example, the collar may be a rib structure, a tubular structure, single full gauge jersey, double jersey or other suitable knit structures that may be selected to achieve a desired characteristic in the collar 116. As shown in FIG. 1, the collar 116 may be a double jersey knit structure that is a relatively more dense knit structure than the body 154 and the throat area 112. The collar 116 may be formed from the fourth yarn 150 (e.g., the relatively elastic yarn, such as E08 described above). While the collar 116 may be exclusively knit by the fourth yarn 150, it is also contemplated that one or more of the first, second and/or third yarns 144, 146, 148 may be present in the collar 116. The relatively high degree of stretch and/or elasticity provided by the fourth yarn 150 imparts stretch to the collar 116 that may provide ease of entry of a wearer's foot into the void while also allowing the upper 102 to conform to the foot when worn, and enhance comfort and fit.

Referring now to FIGS. 1 and 3, the article of footwear 100 may include one or more additional components or elements. The additional components or elements may provide additional advantageous characteristics or properties. In one embodiment, the additional knitted component 136 may be knitted to form a heel element 134. While the heel element 134 may be formed from the first knitted component 132 that forms the upper 102, the heel element 134 may be formed separately from the upper 102, such as from the second or additional knitted component 136, for example, and then secured to the knitted component 132 that forms the upper 102. The heel element 134 may be a single, unitary, one-piece structure formed by the additional knitted component 136 or it may be formed from multiple pieces that are attached together to form the heel element 134. The heel element 134 may be secured to the upper 102 by stitching, bonding, adhesives or other suitable mechanisms of coupling or attachment.

It is also contemplated that the heel element 134 may be removable, such that attachment to the upper 102 may not necessarily be permanent or irreversible in some embodiments. In a non-limiting example, the heel element 134 may have one or more holes or apertures 158 formed therein which may generally align with one or more of the lace apertures 126 formed in the throat area of the upper 102. When a shoelace or other similar securing mechanism is threaded through the one or more apertures 158 formed in the heel element 134 as well as the lace apertures 126 formed in the upper 102, the lace may secure the heel element 134 in place, snugly against the first side 130 or inner surface of the upper 102 within the void 118 in the heel area 122 of the article of footwear. Heel element 134 may provide additional structure, support and form to the heel area 122 of the upper, as well as soft hand, breathability, cushioning, comfort and enhanced fit, for example.

Figure 4:
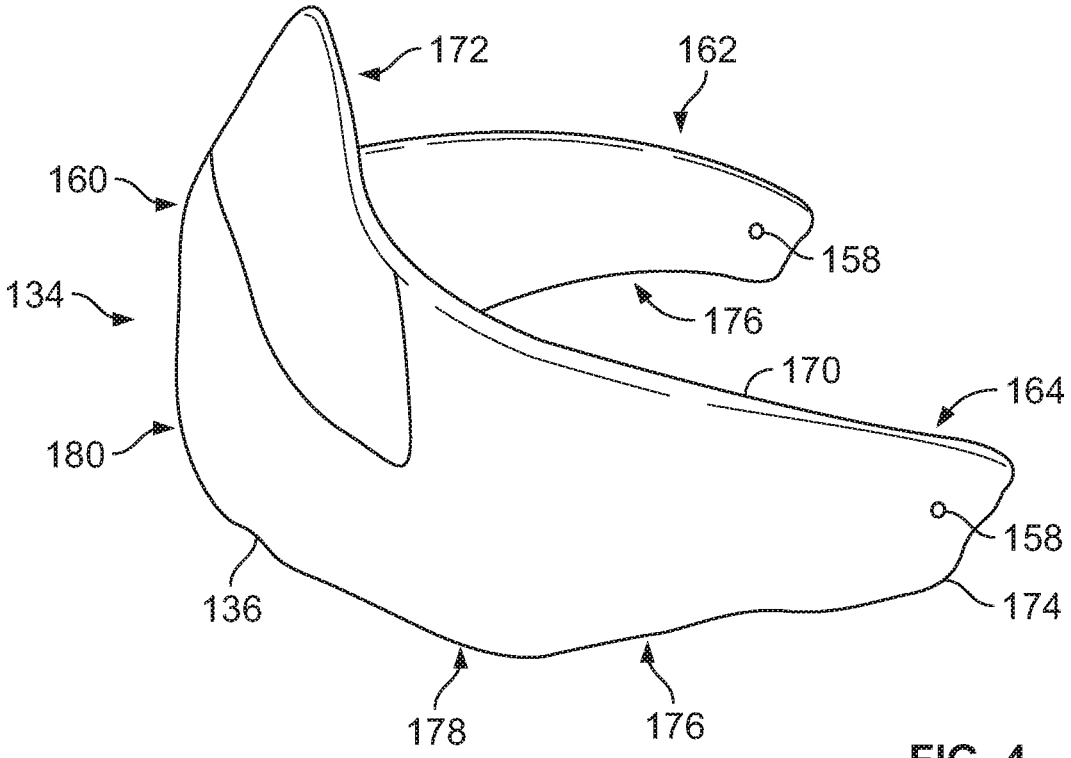
FIG. 4 is an illustration showing a side view of an embodiment of a heel element in accordance with certain aspects of the present disclosure.
Figure 5:
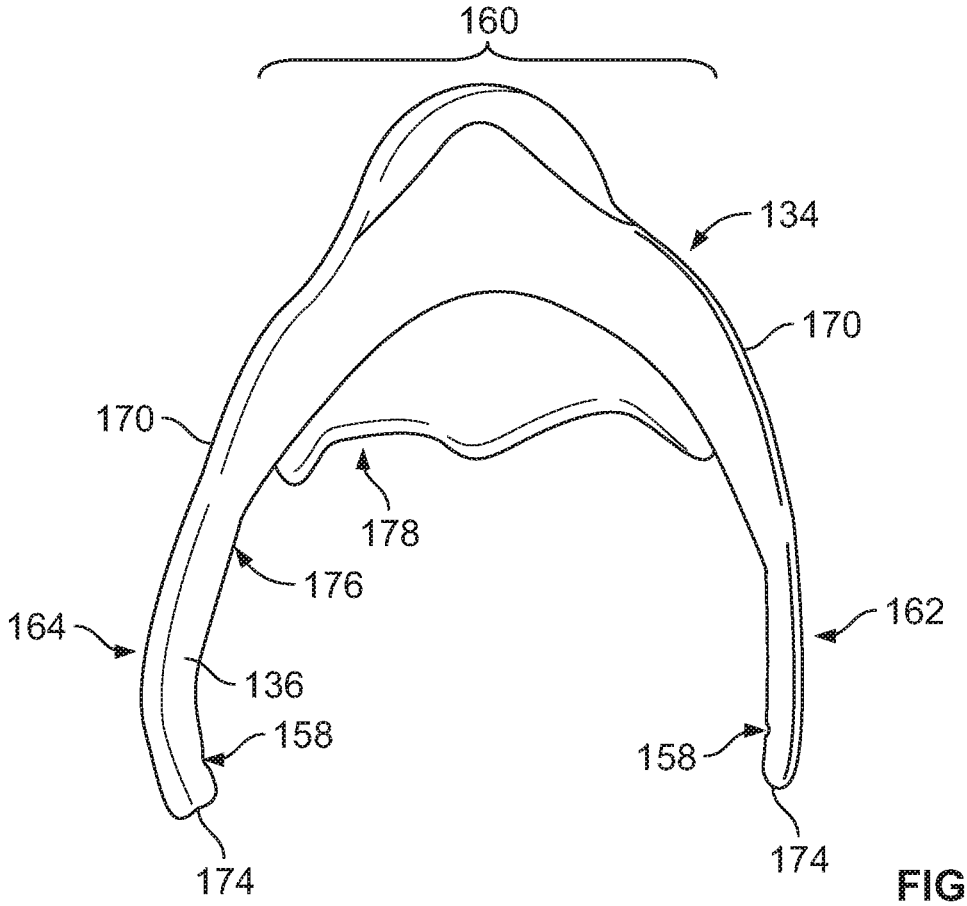
FIG. 5 is an illustration showing a view of an inner surface of the heel element of FIG. 4.
Figure 6:
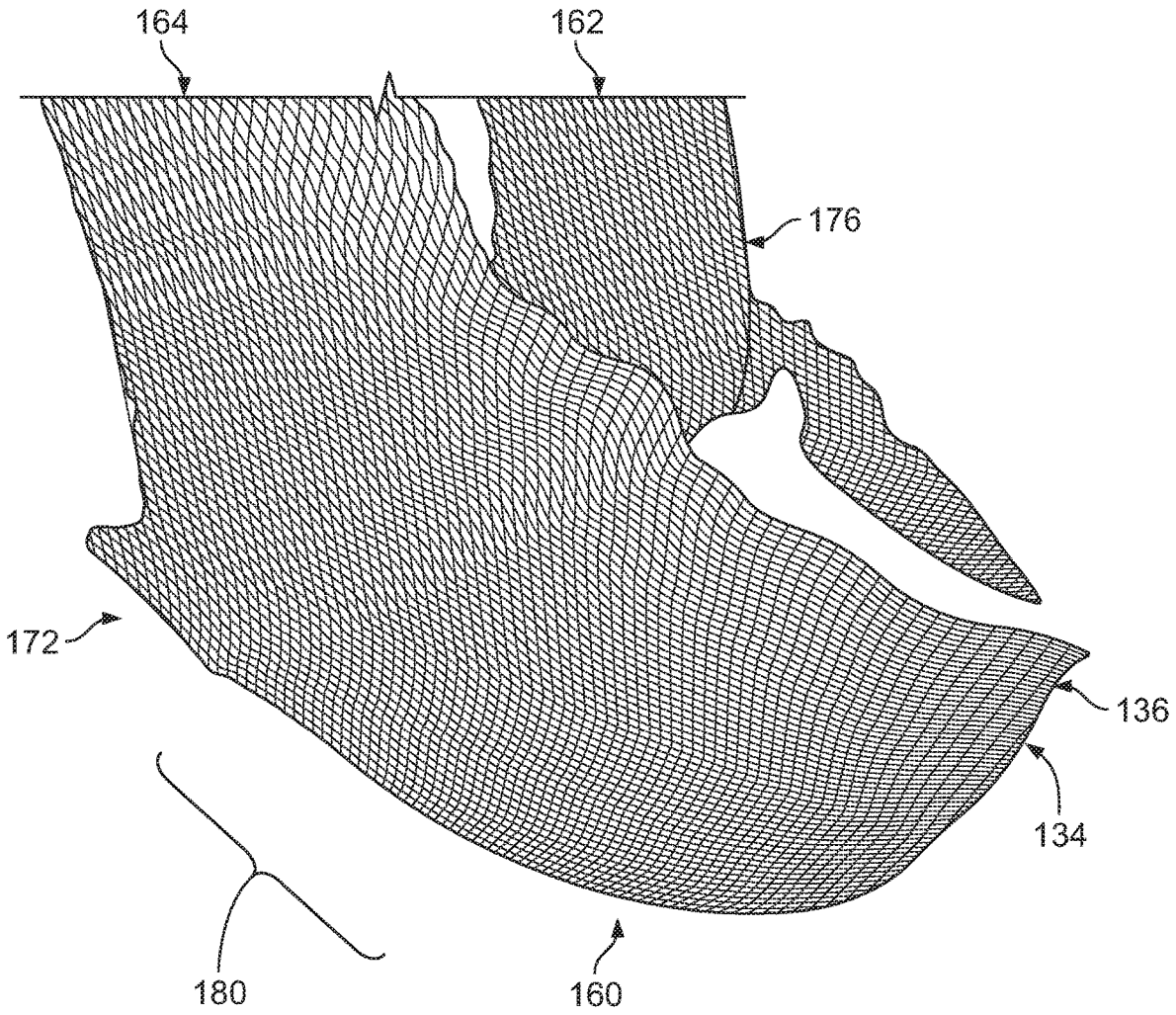
FIG. 6 is an enlarged view of a portion of an outer surface of the heel element of FIG. 4.

One example of a heel element 134 is shown in FIGS. 4, 5 and 6. As shown there, the heel element 134 generally comprises a central body portion 160 with a first arm 162 and a second arm 164 extending outwardly away from the central body portion 160. The heel element 134 has an inner surface 166 and an outer surface 168. When properly placed in its intended position within the void 118 of the article of footwear 100, the outer surface 168 of the heel element 134 would be adjacent to and/or abut the first side 130 of the upper 102. The inner surface 166 of the heel element 134 would generally face the void 118. The first arm 162 would extend towards at least one of the lateral and medial side 106, 108 of the upper 102, while the second arm 164 would extend towards the other of the lateral and medial side. The central body portion 160 of the heel element 134 may generally align with a center portion or "spine" of the heel area 122 of the upper 102.

As shown in FIGS. 4 and 5, the heel element 134 may have an upper or top edge 170 extending along the top of the first arm 162, across and along the top of the central body portion 160 and along the top of the second arm 164. In one embodiment, when the heel element 134 is positioned within the void 118 of the article of footwear 100, at least a portion of the top edge 170 may extend above the first collar 116 formed by the upper 102. As such, the top edge 170 of the heel element 134 may form a second collar 172 for receiving the foot of wearer as shown in FIG. 1. The central portion of the body portion 160 may extend upwards, such that the top edge 170 of the body portion 160 extends above the top edge 170 of the first arm 162 and second arm 164. Thus, when the heel element 134 is properly placed in its intended position within the void 118 of the article of footwear 100, the central portion of the body portion 160 of the heel element 134 may extend higher upon a wearer's ankle to cover at least a portion of the Achilles tendon, for example.

Furthermore, the heel element 134 may comprise a generally consistent knit density throughout, but in other embodiments, the heel element 134 may have different knit densities in different regions. For example, the portion of the heel element 134 that extends above the first collar 116 of the upper 102 may be less densely knit than other portions of the heel element 134. As such, the portions of the heel element 134 that lie behind the upper 102 and which may be adjacent the first side 130 of the upper 102 may have a relatively more densely knit structure.

The first arm 162 and the second arm 164 each have a forward edge 174. A bottom edge 176 of the heel element 134 extends along the bottom of the first arm 162, across and along the bottom of the central body portion 160 and along the bottom of the second arm 164. The heel element 134 may be knitted in a generally flat or two-dimensional configuration as it comes off the knitting machine. However, it may be shaped into a three-dimensional configuration before it is placed in its desired location within the void 118 of the article of footwear 100. For example, the heel element 134 may be shaped on a last to form a gently curved or concaved structure that generally corresponds to the shape of the heel area of the upper 102, such that it is configured to receive the foot of a wearer, for example.

When formed into a three dimensional configuration, such as that shown in one exemplary embodiment of FIGS. 4-6, the first arm 162 and second arm 164 extend generally forward in a direction towards the throat area 112 and/or the toe area 124 of the article of footwear 100. Thus, it can be seen that the forward edges 174 also face in a generally forward direction within the void 118. As previously mentioned, one or both of the first arm 162 and the second arm 164 may include one or more apertures, openings or holes 158 formed therein. In one example, the one or more holes 158 formed in either or both of the first arm 162 and/or the second arm 164 may generally align with one or more of the lace apertures 126 formed in the throat area 112 of the upper 102. As shown in FIGS. 4 and 5, the first arm 162 and the second arm 164 each include at least one opening or aperture or hole 158 which generally aligns with the top-most lace aperture 126 formed in the upper 102. When a lace element is threaded through the lace aperture 126 formed in the upper 102, the lace may also extend through the holes 158 formed in the first arm 162 and the second arm 164 formed in the heel element 134.

The heel element 134 may include an underfoot portion 178 that is configured to extend at least partially under the foot of a wearer. In one example, the underfoot portion 178 may be integrally formed with the knitted component 136 that forms the heel element 134, such that the heel element 134 and the underfoot portion 178 are a unitary one-piece structure. In another embodiment, as shown in FIG. 5, the underfoot portion 178 is a separately formed knitted structure that is attached to the heel element 134. While the underfoot portion 178 of FIGS. 4-6 is a knitted component, it is contemplated that the underfoot portion 178 can be formed from other non-knitted textiles or materials.

In one embodiment, the underfoot portion 178 may extend only a small distance under the foot of a wearer, such that the underfoot portion 178 extends to approximately the biteline 110 where the upper 102 meets the sole structure 104. In other embodiments, the underfoot portion 178 may extend a farther distance underfoot, such as under the ball of the heel of the foot of a wearer. In still further embodiments, the underfoot portion 178 may extend still a further distance underfoot, such as far forward as the midfoot region 120 of the article of footwear 100. The underfoot portion 178 may extend the entire distance between the lateral and medial side 106, 108 of the upper 102 or the underfoot portion 178 may extend only a portion of the distance between the lateral and medial sides. A strobel, insert, liner or midsole structure (not shown) may extend over the top of the underfoot portion 178 (sandwiching the underfoot portion 178 between the strobel and the upper surface of a sole structure 104, for example) or alternatively, the foot of a wearer may directly contact the underfoot portion 178 of the heel element 134.

The heel element 134 may be formed by one or more yarns and knitting techniques to impart certain advantageous properties and characteristics. The heel element 134 may be formed from a full-gauge knit, half-gauge knit or lesser gauge, and may be a single layer or a double layer structure. In the case of a double-layer structure, a pocket may be formed between the layers which may be configured to receive one or more additional structures or elements, including but not limited to padding and the like. In one example, the heel element 134 is formed from a double jersey knit, although it shall be appreciated that other types of knit structures could be used including a single jersey, a ribbed structure, a mesh structure, a jacquard knit structure and combinations thereof.

The heel element 134 may be formed of one or more of the same yarns of the first knitted component 132 that forms the upper 102, or the yarns may be different. In one non-limiting example, the heel element 134 comprises the first yarn, second yarn, and third yarn 144, 146, 148 used to form the body 154 of the upper 102 as well as the fourth yarn 150 used to form the throat area 112 and the first collar 116 of the upper 102. In addition to the first, second, third and fourth yarns 144, 146, 148, 150, the heel element 134 may further include a fifth yarn 151. The fifth yarn 151 may be the same as the other yarns or it may be different. In one embodiment, the fifth yarn 151 may comprise thermoplastic polymer materials. More specifically, the fifth yarn 151 may comprise a thermoplastic polyurethane, or TPU. The TPU may be a coated yarn consisting of a multifilament polyester core yarn (150D) that is coated with a TPU resin sheath with a melting temperature of about 115-120 degrees C. (having a 750D total yarn size). In one non-limiting example, two ends of 550 denier TPU yarn may be used, which may be sold under the trade name Dream-Sil®, a thermoplastic polyurethane coated yarn manufactured by Sambu Fine Chemical Co., LTD.

As such, when the heel element 134 is exposed to a stimulus, such as post-processing methods including steaming, heat pressing and the like, the resin sheath of the fifth yarn 151 may melt, whereas the polyester core, having a higher melting temperature, does not. As mentioned above, yarns that have a melting temperature below about 140 degrees C. (or, in this case a resin sheath having a melting temperature below about 140 degrees C.) may be referred to or identified as a "fusible yarn" like the second yarn 146 formed of thermoplastic polymer materials described above (i.e. the K-85).

The first, second, third, fourth and fifth yarns 144, 146, 148, 150, 152 may be knitted together to form the heel element 134, or the yarns may be knitted in certain combinations or patterns. For example, one or more of the yarns may be fed together on a particular feeder of a knitting machine or, in another example, a certain course of the knitted component 136 may include one or more of the first, second, third, fourth and fifth yarns 144, 146, 148, 150, 152 or combinations thereof, while another course of the knitted component 136 may be formed from others of the aforementioned yarns or combinations thereof.

The fifth yarn 151, or TPU, may preferably have a higher melting temperature than any one or more of the first, second, third and/or fourth yarns 144, 146, 148, 150. The fifth yarn 151 may impart certain properties that are advantageous for including in a heel element 134, such as, for example, stiffness, rigidity, shape, structure, durability and/or strength. When subjected to heat and/or pressure during a post-processing procedure (and, if desired, placing the heel element 134 on a last for molding and shaping) the fifth yarn 151 may allow the heel element 134 to retain its form and provide the desired rigidity shape and structure. While the fifth yarn 151 may be present in the entire heel element 134 and/or the underfoot portion 178 of the heel element 134, the fifth yarn 151 may be present in certain areas of the heel element 134 and present in only relatively small amounts or entirely absent from the underfoot portion 178.

For example, the fifth yarn 151 may be more concentrated in certain areas of the heel element 134 and less concentrated in others. This may provide more rigidity and structure to the areas where the fifth yarn 151 is more highly concentrated. As shown in FIG. 6, the fifth yarn 151 may be more concentrated in the central zone 180 of the central body portion 160 from an area just below the second collar 172 of the heel element 134 to an area adjacent to the bottom edge 176. The fifth yarn 151 may also extend at least partially into the first arm 162 and the second arm 164 as necessary and desired to provide the appropriate stiffness, rigidity, shape and structure to the heel element 134.

As shown in FIGS. 4 and 5, the top edge 170 of the heel element 134 which may form at least a portion of the second collar 172 may be formed from the fourth yarn 150 (the relatively elastic yarn, such as E08 described above, or other relatively elastic yarns). It is also contemplated that the forward edges 174 of the first arm 162 and the second arm 164, as well as the bottom edge 176 of the heel element 134 may also be formed from the fourth yarn 150, or other suitable elastic yarns. The underfoot portion 178 may also be formed from the fourth yarn 150, and preferably, the underfoot portion 178 may be formed substantially or entirely of the fourth yarn 150 or other suitable elastic yarns.

The fourth yarn 150 may be more concentrated in certain areas of the heel element 134 and less concentrated in others. This may provide more stretch, resilience and compliance to the areas where the fourth yarn 150 is more highly concentrated. As shown in FIGS. 4 and 6, the fourth yarn 150 may be more concentrated in the top edge 170 and/or adjacent the top edge 170 including, in one example, the area formed by the second collar 172 of the heel element 134 that extends above the first collar 116 of the upper 102. The fourth yarn 150 may also be more concentrated in the bottom edge 176 and/or in an area adjacent the bottom edge 176, such as an area adjacent to the biteline 110. The concentration of the fourth yarn 150 in an area that lies between the first area and the third area, including, for example, central zone 180, may be less concentrated, thus providing a "high-low-high" elastic "gradient" in the heel element 134. The fifth yarn 151 may also extend at least partially into the underfoot portion 178 of the heel element 134.

Once the heel element 134 has been knitted and then lasted to form a three-dimensional structure such as that shown in FIGS. 4-6, it may be inserted through the first collar 116 of the upper 102 and into the void 118 of the article of footwear. The central body portion 160 of the heel element 134 may generally align with the center of the heel area 122 of the upper 102. The heel element 134 may be attached to the upper 102 as already described above, and, if apertures or holes 158 are present in the first arm and/or second arm 162, 164, a lace element can be fed there through. As such, when the laces are tightened by a wearer, the tension of the laces may pull the heel element 134 slightly forward to enhance fit, containment and comfort.

Figure 7:
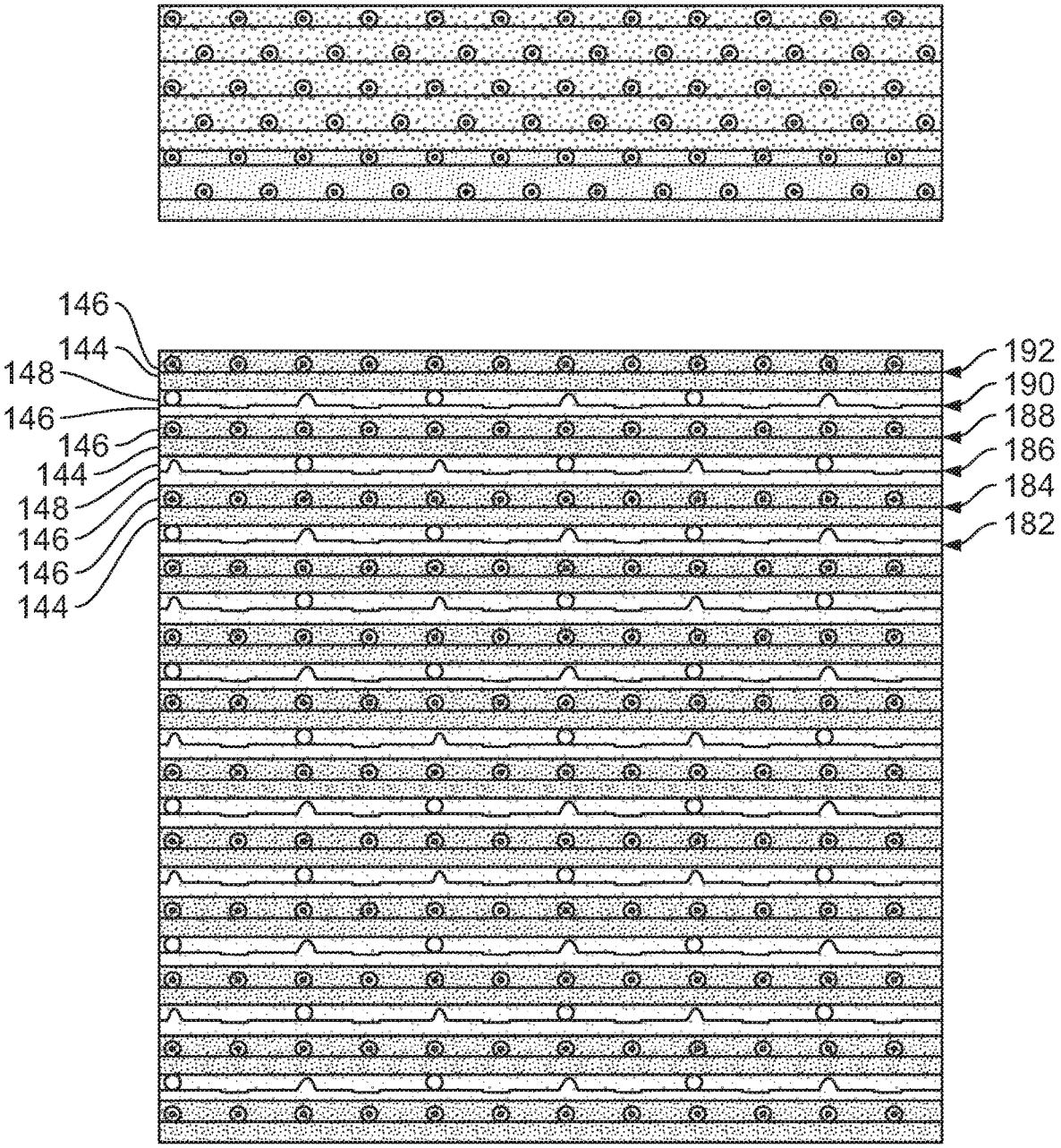
FIG. 7 is a program view of a knitting sequence for forming a knitted component in accordance with certain aspects of the present disclosure.

Turning now to FIG. 7, a knit program 182 used to form at least a portion of the knitted component 132 will be described. In other words, the knit program 182 described hereinafter forms the portion of the upper 102 formed from the first, second and third yarns 144, 146, 148, which, in exemplary FIG. 1, is the majority of the upper (referred to herein as the "body" 154 of the upper) excluding the throat area 112 and/or the collar 116. It is noted that the inlaid component 152 is not represented in the knit program 182. Thus, the inlaid component 152 may be incorporated into the knitted component 132 during the knitting process or it may be inlaid as a separate or additional step following the knitting process.

First, looking to FIG. 7, a program view of a knit program is illustrated. As shown, the knitted component 132 is formed on a knitting machine having a single bed, although it is contemplated that two beds may be used to form at least a portion of the knitted component 132. It can be seen that the knitting is formed on every other needle of the needle bed, thus forming the previously described half-gauge structure, resulting in a lightweight and at least partially translucent or transparent upper, yet strong and having high containment (or "lock out") due to the use of one or more high tenacity yarns.

The knit diagram illustrates a first course 184 knit on a single needle bed. The first course includes a combination of the first yarn 144 (the high tenacity polyester) and the second yarn 146 (the fusible yarn). The combination of the first yarn 144 and the second yarn 146 is knit on every other needle of the needle bed.

A second consecutive course 186 is then knit following the first course 184. The second course 186 includes a combination of the second yarn 146 (the fusible yarn) and the third yarn 148 (the high tenacity polyester "sewing thread"). The combination of the second and third yarn 146, 148 are tucked on one needle (shown as an upside-down "U" in the diagram) which tucks on top of the first and second yarns 144, 146 of the first course 184. Following the tuck stitch of the second course 186, the second and third yarns 146, 148 float three needles then knit on the fourth needle. As shown in the knit program 182, this sequence can then be repeated, starting again with a tuck stitch.

A third consecutive course 188 is then knit following the second course 186. The third course 188 is a repeat of the first course 184, which includes a combination of the first yarn 144 (the high tenacity polyester) and the second yarn 146 (the fusible yarn). The combination of the first yarn and the second yarn 144, 146 is knit on every other needle of the needle bed.

A fourth consecutive course 190 is then knit following the third course 188. The fourth course 190 includes a combination of the second yarn 146 (the fusible yarn) and the third yarn 148 (the high tenacity polyester "sewing thread"). The combination of the second and third yarns 146, 148 are knitted on one needle, then float three needles. Following the three needle float, the combination of the second and third yarns 146, 148 are then tucked (shown as an upside-down "U" in the diagram) which forms a tuck stitch on top of the first and second yarns 144, 146 of the first course 184. Following the tuck stitch, the second and third yarns 146, 148 again float three needles then knit again on the fourth needle. As shown in the knit program 182, this sequence can then be repeated, starting again with the knit loop on the fourth needle following the float sequence.

A fifth consecutive course 192 is then knit following the fourth course 190. The fifth course 192 is a repeat of the first and third courses 184, 188, which includes a combination of the first yarn 144 (the high tenacity polyester) and the second yarn 146 (the fusible yarn). The combination of the first yarn and the second yarn 144, 146 is knit on every other needle of the needle bed.

The knit sequence of FIG. 7 may be repeated, as necessary, to form a knitted component with a suitable size. Further, it is noted that the sequence(s) may be varied to incorporate different features by changing certain knit structures, by varying yarn types, by increasing or decreasing the number of courses at each step, or by any other suitable adjustment to the knitting process or materials used. Further, other sequences may be used before, after, or between the sequences described above.

Figure 8:
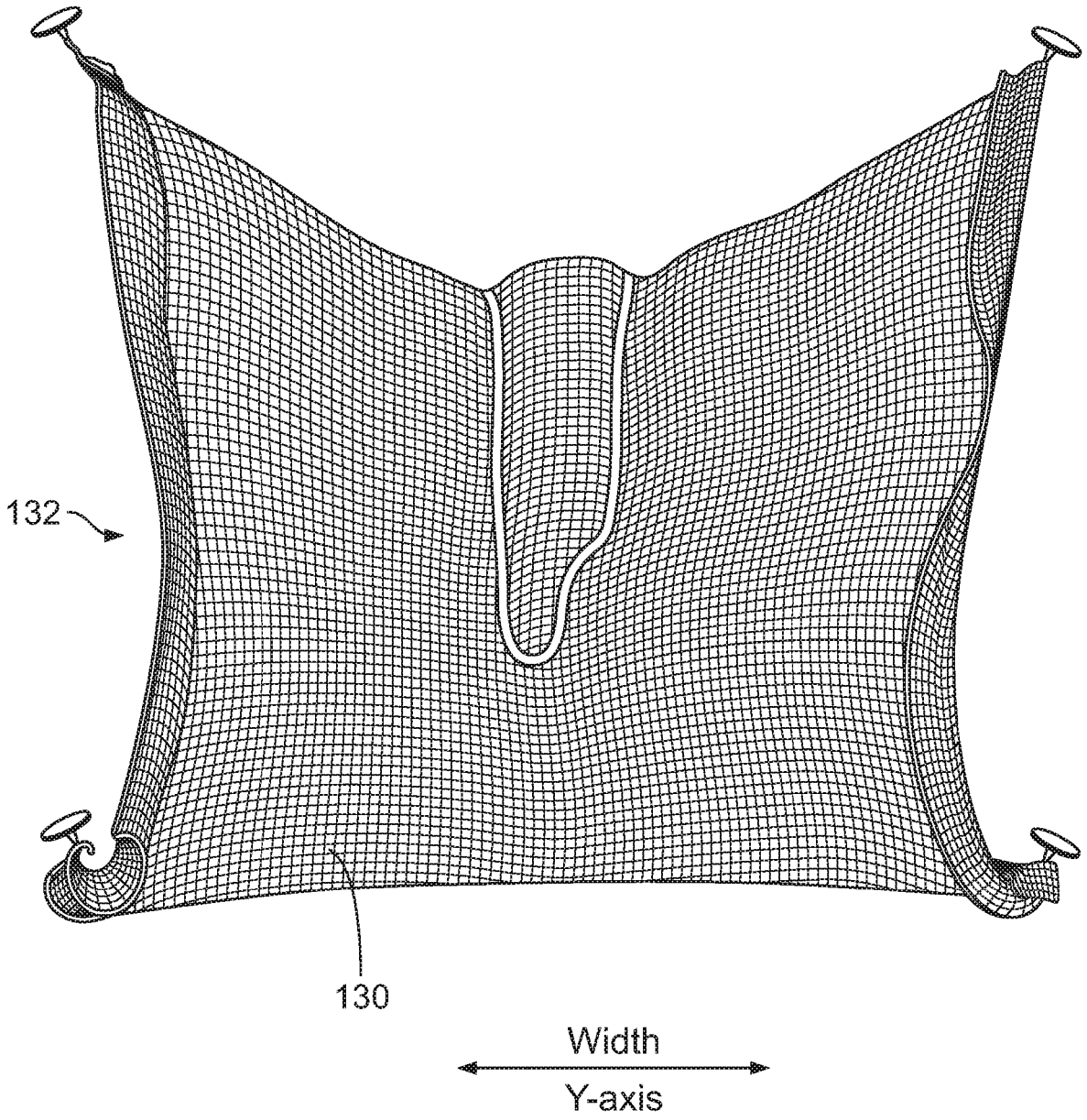
FIG. 8 illustrates one example of a knitted component in an unstretched condition in accordance with certain aspects of the present disclosure.
Figure 9:
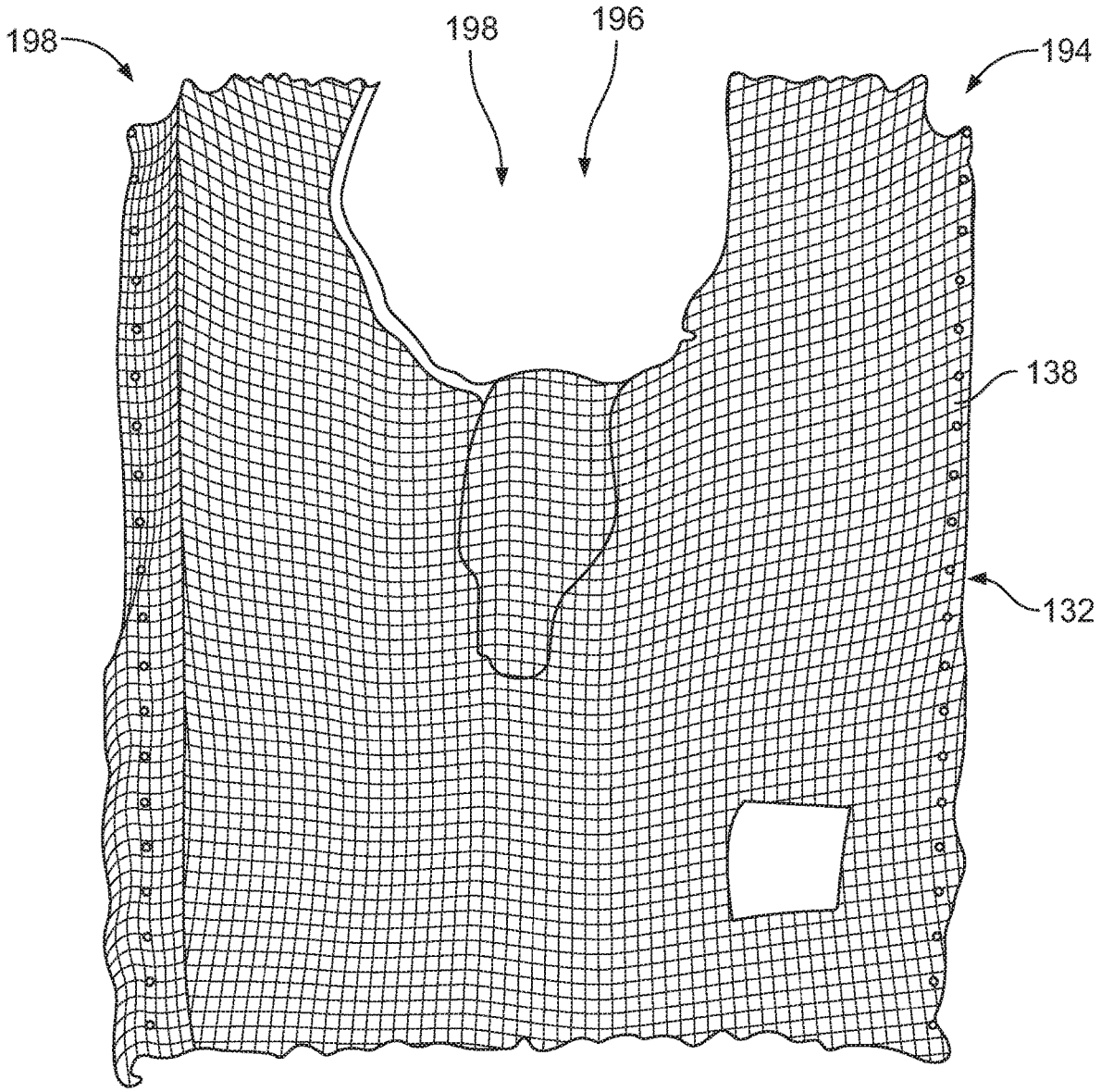
FIG. 9 illustrates one example of a knitted component in a stretched condition mounted on a jig in accordance with certain aspects of the present disclosure.
Figure 10:
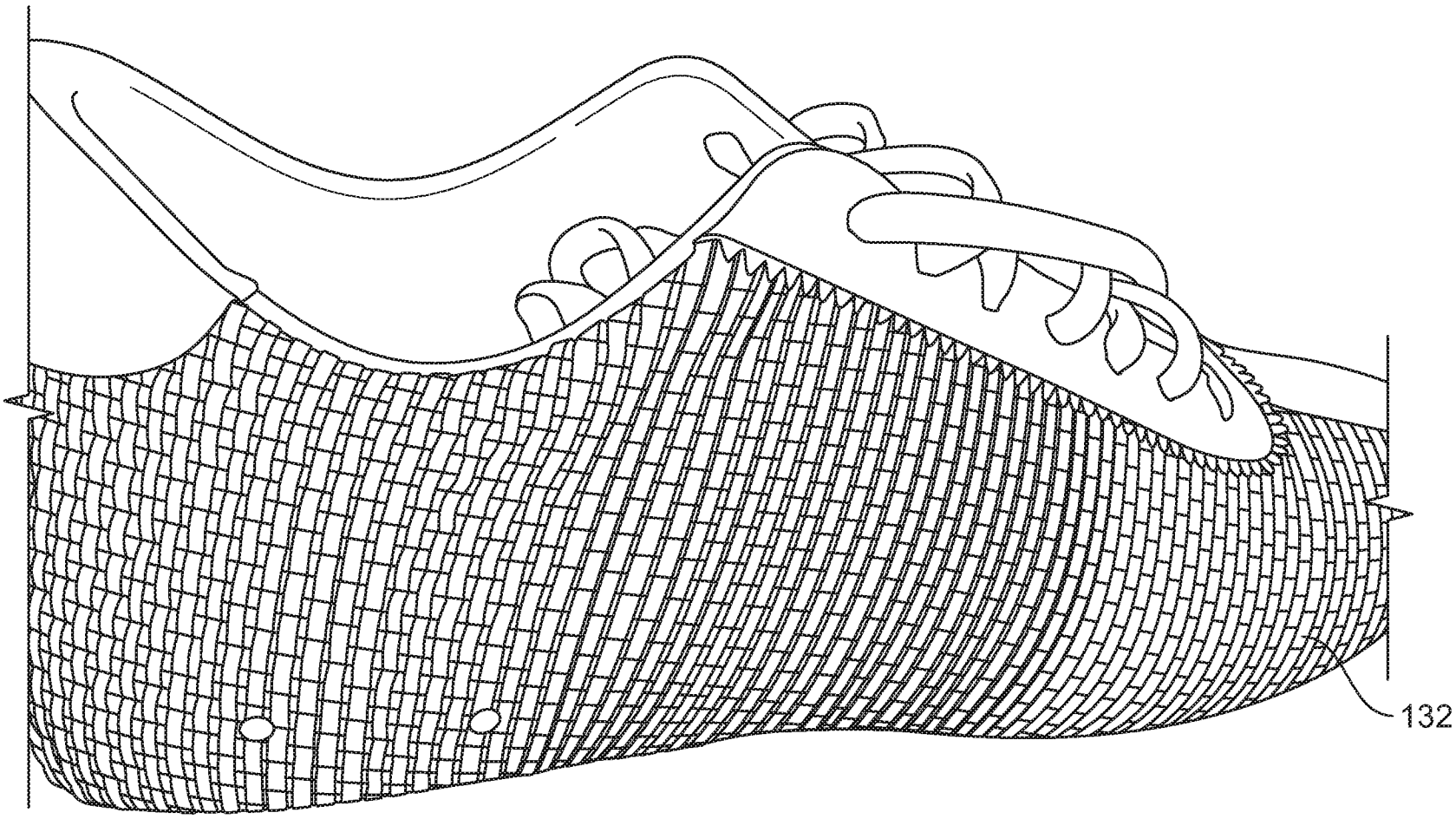
FIG. 10 is an illustration showing a side view of one embodiment of an article of footwear in accordance with certain aspects of the present disclosure.

Referring now to FIGS. 8 and 9, processing of the knitted component 132 and formation of the upper 102 for an article of footwear are described. After the entirety of the upper 102 is formed, including the body 154 of the upper (using the knit sequences described above) and further including the throat area 112 and first collar 116, the knitted component 132 may be subjected to one or more post-processing methods. In one example, it may be desirable to remove or otherwise eliminate a pre-determined amount of mechanical stretch of the knitted component 132 before it is assembled onto a sole structure 104 to form an article of footwear 100. In one example, at least a portion of the mechanical stretch may be removed from the knitted component 132, and in other examples, it is preferable to remove substantially all of the mechanical stretch from the knitted component 132.

One non-limiting example of a test method used to illustrate the physical property measurements and stretch of a swatch or test sample of the knitted component 132 (comprising the first, second and third yarns 144, 146, 148) is set forth below:

| Sample | Breaking Strength (kgf) | Stiffness (kgf @ 10% strain) | Basis Weight (g/m2) |
|---|---|---|---|
| Machine Direction | 82-96 | 10-17 | 250-375 |
| Cross Machine Direction | 63-72 | 12-19 | |

In the chart above, fabric breaking strength and stiffness were determined using an Instron model 5565 equipped with Bluehill 3 analysis software. Test specimens (3"×6") were cut in both the machine and cross machine directions and tested using 1" flat faced grips. Samples were tested using a 3" gauge length and a crosshead speed of 4 in/min. The breaking strength of the fabric was determined at the point of the first yarn break. Stiffness of the fabric was taken as the load (kgf) at 10% elongation.

In the example above, the stiffness may refer to the force needed to stretch the sample a certain amount. This may provide information relating to how much lock out or containment is provided when this textile is formed into an upper 102 for an article of footwear 100. The basis weight may refer to the grams per square meter for the specific sample size used. In other words, this measurement provides a normalized weight of a particular size sample swatch of the textile, which can then be used to calculate different sizes of the textile, such as the weight of an amount of the textile used to form an upper 102.

To remove the desired amount of mechanical stretch, the knitted component 132 may first be stretched from its original first unstretched state (see FIG. 8) to a second stretched state (see FIG. 9). The knitted component 132 may be stretched in a cross-machine direction, which comprises stretching the knitted component in a course-wise direction, or width along the x-axis. The knitted component 132 may also be stretched in a machine direction, which comprises stretching the knitted component in a wale-wise direction, or length along the y-axis. The knitted component 132 may be stretched in only one of these directions, but preferably, the knitted component 132 is stretched along both the length and width. When an inlaid component is included (shown in FIGS. 10-13), the knitted component 132 may be stretched in a direction that is parallel to the inlaid component 152, in a direction that is perpendicular to the inlaid component 152, or both. In one non-limiting example, it was determined that the upper 102 had a relatively greater ability to stretch in a direction that is perpendicular to the direction of the inlaid component 152 (e.g., since the inlaid component 152 may itself be resistant to stretching). For example, where the inlaid component extends in a heel to toe direction, there may be greater stretch in the lateral to medial direction (at least in a pre-processed state). Whereas, where the inlaid component extends generally in a lateral to medial direction, there may be greater stretch in the heel to toe direction. However, it is also contemplated that the inlaid component 152 may have little to no effect on the general stretch characteristics of the knitted component 132 into which it is inlaid. Further, in embodiments where it is desirable to stretch the knitted component 132 in a direction parallel to the lengthwise direction of at least one inlaid component 152 (e.g., to remove elasticity in that direction after "processing" as described below), the inlaid component 152 may initially include slack, and such slack may be removed during the stretching step such that the inlaid component 152 is substantially taught (and/or stretched relative to its relaxed state) after post-knit processing.

It is estimated that above a 12% stretch in both width and length could be a base level that may provide a desirable amount of the desired lockout benefit to a wearer when the knitted component 132 is formed into the upper 102. However, stretching less or more than 12% is also contemplated. One example of stretch percentages is illustrated in the chart below. As shown, a 50 mm×50 mm test swatch of a knitted component 132 is stretched in both a length wise and width wise direction. "Unprocessed" refers to a sample of the knitted component 132 before stretching and steaming, while "processed" refers to the same sample after stretching and exposure to steam. The unprocessed state has a baseline of 100%, such that after processing (the "processed state") it has been stretched 14% in the width direction and 21% in the length direction. It can be seen that the unprocessed sample weighed 1.3 grams, and, after stretching and steaming, it weighed 0.9 grams. The loss of mass may be attributable to various factors, including but not limited to stretching, where the density of the textile is reduced while the size increases. Also, reduction in mass may also be the result of any fusible material present in the yarns being lost due to the steaming process.

| | Unprocessed | Processed | Stretch % |
|---|---|---|---|
| W (mm) | 370 | 420 | 114% |
| H (mm) | 380 | 460 | 121% |
| 50 mm × 50 mm | 1.3 grams | 0.9 grams | |

In order to satisfactorily stretch the upper 102 in preparation for post-processing methods such as steaming and/or heat pressing, the upper 102 may be secured to a stretching mechanism or device. This may include stretching the upper 102 in one or more directions with the inlaid component 152 present/incorporated into the upper 102. In one example, the stretching device may be a jig 194. As shown in FIG. 9, a jig 194 may be used to hold and/or position the upper 102 during the steaming (heat) process. In other processing methods, the jig 194 may be used to hold and/or position the upper 102, or other knitted components (such as the heel element 134) during heating and exposure to pressure, such as by heat pressing. The jig 194 may be a separate element from the steaming device and/or, in the case of a heat press, the jig 194 may be disposed on a bottom plate of a heat press.

The jig 194 may have a top section (not shown) and a bottom section 196, which may be formed using any material, such as rubber or metal or polymers or combinations thereof. If the material used to form the jig 194 has a melting temperature, the melting temperature should be above the typical temperature achieved during the steaming or heat-pressing process to ensure that the heat does not disfigure, alter, damage or otherwise negatively affect the jig 194. The shape and configuration of the jig 194 is also not limited. In FIG. 9, the shape of the jig 194 is generally rectangular. Also, the jig 194 may be a solid surface or plate, or, as shown in the cut-away portion of the knitted component 132 in FIG. 9, the jig 194 have cut outs or openings formed therein to allow steam or heat or other forms of stimulus to pass through the jig 194 and make contact with the knitted component 132.

The jig 194 may also include a positioning mechanism or device. As shown, the positioning mechanism includes a plurality of spring-loaded pins 198 that are configured to position the upper 102 on the jig 194. Here, the shape formed by the plurality of spring-loaded pins 198 is substantially the same as the shape of the knitted component 132 being stretched and positioned on the jig 194. It is also contemplated that the shape formed by the plurality of pins 198 generally corresponds to the shape of an upper 102 such that it corresponds with the outer perimeter of the upper 102. The knitted component 132 or upper 102 may include a plurality of apertures configured to receive the spring-loaded pins 198, and/or the spring-loaded pins may penetrate through the knitted component (or upper) as shown in FIG. 9 to hold it in position upon and within the jig 194.

The jig 194 may further include a pad (not shown) configured to prevent the upper 102 from sticking to the jig 194 and/or a heat press. The pad may be insulative and/or provide cooling on one or both sides of the upper 102. In one example, the pad may generally be in the shape of the entire upper, or it may be shaped and sized to a particular area of the upper 102. The thickness of the pad may reduce the amount of heat applied and even reduce or substantially prevent the areas of the upper 102 not corresponding to a fused area (e.g., the throat area 112) from being steamed and/or pressed, directly heated and/or burned. In one embodiment, the pad is formed of Teflon and is approximately 5 mm thick, though any suitable thickness may be used. The spring-loaded pins 198 are configured to compress if necessary during the heat-pressing process such that they do not inhibit the pressure applied to the knitted component 132 (e.g., if the spring-loaded pins 198 are longer than the thickness of the knitted component 132). In some embodiments, the jig 194 may be configured such that two or more knitted components 132 can be processed simultaneously.

When performing a heat pressing process (as opposed to only steaming process) a release paper (not shown) may be placed over certain areas of the knitted component 132. The release paper is preferably constructed of a material that reduces or prevents the certain area of the upper 102 from sticking to it and therefore, the release paper may also prevent the certain areas of the knitted component from sticking to the jig 194. The release paper may be configured to allow heat to be conducted to the knitted component 132 directly through the release paper and without interfering in the heating process.

For a steaming process, the jig 194, with a knitted component 132 secured thereto, may be placed into a steaming mechanism, such as a steam chamber or unit. The knitted component 132 may then be subjected to a predetermined temperature of steam heat for a predetermined period of time. When subjected to this steam, the thermoplastic polymer material present in the knitted component 132, such as the thermoplastic polymer material included with a yarn (i.e., the second yarn 146 described above, for example), may at least partially melt. As a result, the material originally forming separate yarns of the upper 102 may become bonded and/or continuous to form a fused area. In addition the thermoplastic polymer material may at least partially melt with one or more portions of the inlaid component 152 (FIG. 11) incorporated into the knitted component 132. Therefore, any one or more areas where the upper 102 contains thermoplastic polymer material, and where that material is subjected to a suitable process (such as the steaming process described herein), it is contemplated that at least one fused area will be formed. Once the upper 102 reaches a predetermined temperature (e.g., enough to activate the fusible yarn, for example) and/or when the upper 102 has been subjected to the steaming process for a pre-determined amount of time, the jig 194 may be removed from the steam exposure. While steaming and heat-pressing processes are described herein, any other suitable process may be used to form the fused areas.

In the case of a heat pressing process, such as during post-treatment of the heel element 134, the jig 194 may be closed (the top section placed over the bottom section 196) and placed into the heat press. The heat press may be preheated to between about 100° C. and about 150° C. (or any other suitable temperature range). The press may then be activated. In one embodiment, the heat press may apply approximately 8 kg/cm^2 of pressure at between about 120° C. and about 150° C. for a period of 30 seconds. When subjected to this heat and pressure, the thermoplastic polymer material of the knitted component 136 which may form the heel element 134, such as the thermoplastic polymer material included with a yarn (i.e., the fifth yarn 151 described above), may at least partially melt. As a result, the material originally forming separate yarns of the heel element 134 may become bonded and/or continuous to form at least one, or a plurality of fused area(s). Therefore, any one or more areas where the knitted component 132 or 136 contains thermoplastic polymer material, and where that material is subjected to a suitable process (such as the heat-pressing process described herein), it is contemplated that a fused area will be formed. The melting of the thermoplastic polymer material to one or more adjacent portions of the inlaid component 152 may also serve to hold, secure or lock the inlaid component in place, once cooled. A thermocouple (not shown) may measure the temperature of the knitted component 132 or 136 during this process. Once the knitted component 132 or 136 reaches a predetermined temperature (e.g., between about 120° C. and about 132° C.), the heat press may open, and the knitted component 132 or 136 may be removed. While a heat-pressing process is described, any other suitable process may be used to form the fused areas of the heel element 134.

Next, after steaming (the upper 102) and/or heat-pressing (the heel element 134), the heated knitted component 132 and/or 136 may be shaped or formed. In one example, the heel element 134 formed from the second knitted component 136 may be formed on a last or other similar device in order to shape the heel element 134 into a concave, three-dimensional structure that would preferably generally confirm to the shape of a heel of a wearer.

Further, after steaming and/or heating (and shaping, if desired) the knitted component 132 and/or 136 may begin to cool. During cooling, the knitted component 132 that forms the upper 102, for example, may remain positioned on the jig 194 in its stretched condition. As it cools, the thermoplastic material present in any one of the yarns, such as the second yarn 146 present in the knitted component 132, may at least partially fuse together with adjacent yarns in its proximity to within the knitted component 132. Once cooled, the fusible yarn may also enhance one or more mechanical properties of the knitted component 132 and/or 136 (such as strength and/or rigidity) at least in select locations and/or have the effect of securing or locking the relative positions of the yarns within the knitted component. Because the fusible yarn cooled when the knitted component 132 (forming the body 154 of the upper 102) is in its stretched condition, the knitted component may therefore remain in this stretched and expanded condition. Likewise, after cooling of the fusible yarn (i.e., the fifth yarn 151) within the knitted component 136 (forming the heel element 134) the heel element may therefore have greater stiffness, durability and ability to retain shape, for example.

By stretching the knitted component 132 of the upper from a first unstretched condition (FIG. 8) to a second stretched condition (FIG. 9) and steaming it on the jig 194 in the stretched condition, the fusible yarns (such as the second yarn 146) may at least partially melt and infiltrate the adjacent and surrounding yarns (such as the first yarn 144 and third yarn 148). Upon cooling, the fusible yarns can then lock the surrounding yarns into the stretched condition such that this process provides an ability to remove at least a portion, at least half of, substantially all or all of the mechanical stretch of the knitted component 132, as necessary or desired, before it is ultimately removed from the jig 194 and later formed into an upper 102.

As an alternative to natural cooling, the knitted component 132, 136 may go through a cooling process, such as a cold-pressing process. The cooling process may set the fused area(s) or otherwise bring the fused area into a state other than a melted state. In one example, the knitted component 132, 136 may be placed in a cold press. A silicon pad (which may be any other suitable material) may be placed on one or both sides of the knitted component 132, 136, and particularly over the heated and/or partially melted areas, to ensure even pressure. The cold press may include a refrigeration system, but in some embodiments the cold press is at or about at room temperature. When activated, in one non-limiting example, the cold press may apply approximately 15-18 kg/cm^2 of pressure for about 12 seconds. During the cold-pressing process, the release paper may remain attached to the knitted component 132, 136 to prevent the knitted component 132, 136 from sticking to the cold press, though this is not required. The cold press can be used in conjunction with a jig similar to the jig 194 described with respect to the steaming and/or heat-pressing process.

In some embodiments, a heat pressing process may be used to attach an auxiliary component, such as the auxiliary interior element 156 described above, to the upper 102. While not shown, the auxiliary component 156, which may include a thermoplastic polymer material, may be placed in contact with the upper 102 such that it at least partially melts and thereby adheres to the upper 102 during a steaming and/or a heat-pressing process. Alternatively, or in addition, an auxiliary component 156 may be substantially free of a thermoplastic polymer and may be bonded to the upper 102 by placing the auxiliary component 156 in contact with the heated thermoplastic polymer of the upper 102. This may be done in conjunction with the process of forming the fused areas or may be done at a different time.

While the embodiments and other features are described generally herein with reference to an upper 102 for an article of footwear, those features could additionally or alternatively be incorporated into another type of article. For example, the features described herein may be included in articles of apparel (e.g., shirts, pants, socks, footwear, jackets and other outerwear, briefs and other undergarments, hats and other headwear), containers (e.g., backpacks, bags), and upholstery for furniture (e.g., chairs, couches, car seats).

In the present disclosure, the ranges given either in absolute terms or in approximate terms are intended to encompass both, and any definitions used herein are intended to be clarifying and not limiting. Notwithstanding that the numerical ranges and parameters setting forth the broad scope of the present embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the present disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the present disclosure and without diminishing its intended advantages. It is therefore intended that such changes and modifications be covered by the appended claims.

We claim:

1. A method of manufacturing a textile that forms part of an article of footwear, the method comprising:

knitting the textile with at least a first yarn and a second yarn, wherein a melting temperature of the second yarn is less than a melting temperature of the first yarn, and wherein the textile has a first unstretched condition after knitting;

subjecting the textile to a tensioning force to stretch the textile from the first unstretched condition to a second stretched condition;

securing the textile in the second stretched condition to a jig;

exposing the textile to a heat stimulus to melt the second yarn to a softened or liquid state while in the second stretched condition;

allowing the second yarn to cool to transition back to a solid state to retain the textile in the second stretched condition; and removing the textile from the jig.

2. The method of claim 1, wherein the heat stimulus comprises steam.

3. The method of claim 1, wherein the second yarn at least partially fuses together with adjacent yarns within the textile.

4. The method of claim 1, wherein the textile remains substantially fixed in the second stretched condition upon cooling of the second yarn.

5. The method of claim 1, wherein the second stretched condition comprises 12% stretch or more of the first unstretched condition.

6. The method of claim 1, wherein knitting the textile includes inlaying at least one inlaid component within courses formed by at least one of the first yarn and the second yarn.

7. A method of forming a textile upper for an article of footwear, the method comprising:

knitting the textile upper with at least a first yarn and a second yarn, wherein a melting temperature of the second yarn is less than a melting temperature of the first yarn, and wherein the textile upper has a first unstretched condition subsequent to knitting;

securing the textile upper to a stretching device;

applying heat to the textile upper while the textile upper is in a second stretched condition on the stretching device, wherein the second yarn is at least partially melted or softened while the textile upper is in the second stretched condition; and allowing the second yarn to cool and thereby form a fused area that retains at least part of the textile upper in the second stretched condition, wherein the textile upper has a heel region comprising a first elasticity in a first area located at a collar opening, a second elasticity in a second area adjacent to a biteline, and a third elasticity in a third area located between the first area and the second area.

8. The method of claim 7, wherein the third elasticity is less than each of the first and second elasticities.

9. The method of claim 7, wherein the first yarn has a tenacity that is at least 5 grams per denier.

10. The method of claim 7, wherein the second yarn comprises a thermoplastic polymer material.

11. The method of claim 7, wherein the stretching device is a jig.

12. The method of claim 7, further comprising securing the textile upper to a sole structure.

13. The method of claim 7, wherein the heat is applied using a steaming process.

14. The method of claim 7, wherein an inlaid component is inlaid within courses formed by at least one of the first yarn and the second yarn.

15. The method of claim 14, wherein the inlaid component comprises leather.

16. A method of manufacturing a textile component for an article of footwear, the method comprising:

knitting the textile component such that the textile component has an unstretched condition subsequent to knitting;

manipulating the textile component into a stretched condition;

heating the textile component in the stretched condition to melt at least one yarn and form a fused area that holds at least part of the textile component in the stretched condition once cooled; and incorporating the textile component having the fused area into an article of footwear, wherein the textile component is an upper that comprises a heel region comprising a first elasticity in a first area located at a collar opening, a second elasticity in a second area located adjacent to a biteline, and a third elasticity in a third area located between the first area and the second area.

* * * * *